US012799889B2

(12) United States Patent
Taira

(10) Patent No.: US 12,799,889 B2
(45) Date of Patent: Nov. 17, 2026

(54) WORKING MACHINE

(71) Applicant: Kubota Corporation, Osaka (JP)

(72) Inventor: Kensuke Taira, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 19/186,781

(22) Filed: Apr. 23, 2025

(65) Prior Publication Data

US 2025/0334067 A1 Oct. 30, 2025

(30) Foreign Application Priority Data

Apr. 24, 2024 (JP) ..... 2024-070452

(51) Int. Cl.
*F01P 7/06* (2006.01)
*E02F 9/08* (2006.01)
(Continued)

(52) U.S. Cl.
CPC ..... *F01P 7/06* (2013.01); *E02F 9/0866* (2013.01); *F04D 19/002* (2013.01); *F04D 19/005* (2013.01); *F04D 29/362* (2013.01)

(58) Field of Classification Search
CPC ..... F01P 7/06; F04D 19/005; F04D 29/362; F03D 7/0224; F01D 7/00; F01D 7/02;
(Continued)

(56) References Cited

U.S. PATENT DOCUMENTS 2,472,728 A * 6/1949 Sanders ..... F01P 7/06 236/35
2,553,214 A * 5/1951 Sanders ..... F04D 29/362 236/35
(Continued)

FOREIGN PATENT DOCUMENTS

CN 108167059 A 6/2018
DE 2552529 A1 6/1977
(Continued)

OTHER PUBLICATIONS

EP-0967104—translation (Year: 1999).*
Official Communication issued in corresponding European Patent Application No. 25172092.6, mailed on Sep. 12, 2025, 11 pages.

*Primary Examiner* — Courtney D Heinle
*Assistant Examiner* — Behnoush Haghighian
(74) *Attorney, Agent, or Firm* — Keating & Bennett, LLP

(57) ABSTRACT

A working machine includes a fan to generate first and second airflows in different directions. The fan includes a central shaft, rotary blades each extending in a radial direction of the central shaft, and an angle change mechanism to change an angle of each rotary blade relative to the central shaft by turning the rotary blade about an axis in the radial direction. The angle change mechanism includes a movable body that is movable in an axial direction of the central shaft, and a conversion mechanism to convert movement of the movable body into turning movement of the rotary blades. The conversion mechanism includes inserts each inserted in the corresponding rotary blade in the corresponding radial direction, fastenings to fix the corresponding rotary blade and the corresponding insert together, and a turning mechanism to turn each insert about the corresponding axis as the movable body moves.

14 Claims, 26 Drawing Sheets

(51) Int. Cl.
*F04D 19/00* (2006.01)
*F04D 29/36* (2006.01)

(58) Field of Classification Search
CPC ..... B64C 11/06; B64C 11/30; B64C 11/32; F05B 2270/328
See application file for complete search history.

(56) References Cited

U.S. PATENT DOCUMENTS

| | | | | |
|---|---|---|---|---|
| 6,109,871 | A * | 8/2000 | Nelson | F01P 7/06 416/157 R |
| 10,738,681 | B2 * | 8/2020 | Boffelli | F01P 7/06 |
| 2019/0162105 | A1 * | 5/2019 | Boffelli | F04D 19/002 |

FOREIGN PATENT DOCUMENTS

| | | | | |
|---|---|---|---|---|
| EP | 0967104 | A2 * | 12/1999 | F01P 7/06 |
| JP | 2006057627 | A | 3/2006 | |
| JP | 2010236556 | A | 10/2010 | |

* cited by examiner

WORKING MACHINE

CROSS-REFERENCE TO RELATED APPLICATIONS

This application claims the benefit of priority to Japanese Patent Application No. 2024-070452 filed on Apr. 24, 2024. The entire contents of this application are hereby incorporated herein by reference.

BACKGROUND OF THE INVENTION

1. Field of the Invention

The present invention relates to working machines each including a fan to cool mounted apparatus(es).

2. Description of the Related Art

A working machine disclosed in Japanese Unexamined Patent Application Publication No. 2010-236556 is known. The working machine disclosed in Japanese Unexamined Patent Application Publication No. 2010-236556 includes a fan drive controller that can change the direction of airflow generated by rotation of a fan by switching the rotation direction of the fan between a normal direction and a reverse direction.

SUMMARY OF THE INVENTION

The fan drive controller disclosed in Japanese Unexamined Patent Application Publication No. 2010-236556 is configured to switch the rotation direction of the fan between the normal direction and the reverse direction by controlling switching of a switching valve that switches the rotation direction of a hydraulic motor that drives the fan. Therefore, a hydraulic circuit needs to be provided to control the switching of the switching valve that switches the rotation direction of the hydraulic motor. Thus, the device structure becomes complicated.

The "background art" section of Japanese Unexamined Patent Application Publication No. 2010-236556 discloses a technology for changing the direction of airflow generated by rotation of the fan by changing the attachment angles of rotary blades of the fan. In the disclosed technology, gears are provided at the proximal ends of the rotary blades, and the attachment angles of the rotary blades are changed by rotating the gears. Therefore, the proximal ends of the rotary blades are likely to be damaged due to stress concentration.

Example embodiments of the present invention provide working machines each including a fan which can change the direction of airflow generated by rotation thereof and making it possible to eliminate or reduce the likelihood that devices will become complicated and the fan will be damaged.

A working machine according to an example embodiment of the present invention is a working machine including a fan to generate a first airflow to cool one or more apparatuses in a machine body, and a second airflow in a direction different from a direction of the first airflow, wherein the fan includes a central shaft to rotate about an axis, rotary blades each extending in a radial direction of the central shaft, and an angle change mechanism to change an angle of each of the rotary blades relative to the central shaft by turning the rotary blade about an axis extending in the radial direction, the angle change mechanism includes a movable body that is movable in an axial direction of the central shaft, and a conversion mechanism to convert movement of the movable body into turning movement of the rotary blades, and the conversion mechanism includes inserts each inserted in the corresponding rotary blade in the corresponding radial direction, fastenings to each fix the corresponding rotary blade and the corresponding insert to each other, and a turning mechanism to turn each of the inserts about the corresponding axis extending in the corresponding radial direction as the movable body moves.

Each of the rotary blades may include a blade body, and a holder to hold a portion of the blade body that is adjacent to the central shaft. Each of the fastenings may be configured to fix the corresponding holder and the corresponding insert to each other.

Each of the fastenings may extend in a direction parallel or substantially parallel to the central shaft.

The working machine may further include a rotator to rotate together with the central shaft and the rotary blades, the rotator including a tubular portion provided around the central shaft and insertion openings in the tubular portion to receive the respective holders. The movable body may be movable relative to the rotator.

The turning mechanism may include protrusions included in the respective inserts and protruding toward the central shaft, and engagement grooves provided in the movable body to engage with the protrusions. Each of the protrusions may be offset from an axis of the corresponding insert and rotatable in the corresponding engagement groove as the movable body moves. Each of the inserts may be turnable together with the corresponding rotary blade about the corresponding axis extending in the corresponding radial direction as the corresponding protrusion rotates.

Each of the inserts may include a shaft portion inserted in the corresponding holder, and a head portion provided at an end of the shaft portion that is adjacent to the central shaft and located outside the corresponding holder. Each of the protrusions may be integral with the corresponding head portion.

Each of the protrusions may have a shape of an elliptical column.

Each of the fastenings may be configured to fix the corresponding shaft portion and the corresponding holder to each other.

Each of the shaft portions may include a first through hole. Each of the holders may include a second through hole. Each of the fastenings may be a bolt passing through the corresponding first through hole and the corresponding second through hole.

The movable body may include a cylindrical portion provided around the central shaft. The engagement grooves may be provided in the cylindrical portion.

Each of the engagement grooves may include a first groove portion extending in a direction parallel or substantially parallel to the central shaft, and a second groove portion continuous with the first groove portion and extending in a circumferential direction of the cylindrical portion. The movable body may be movable in a first direction along the axial direction, and in a second direction that is another direction along the axial direction. Each of the protrusions may be rotatable in one direction in the second groove portion when the movable body moves in the first direction, and rotatable in another direction in the second groove portion when the movable body moves in the second direction.

The movable body may be movable in a first direction along the axial direction, and in a second direction that is another direction along the axial direction. The angle change mechanism may include at least one spring to bias the movable body in the second direction, and an actuator to move the movable body in the first direction against a biasing force of the at least one spring. The at least one spring may include a first spring located radially outward of the cylindrical portion.

The at least one spring may include the first spring and a second spring located radially inward of the cylindrical portion.

The movable body may include a flange portion integral with the cylindrical portion. The first spring may be attached to a hole in the flange portion.

The working machine may further include thrust bearings each of which is attached to an outer peripheral surface of the corresponding shaft portion and contacting an opposite surface of the corresponding head portion from the corresponding protrusion.

The above and other elements, features, steps, characteristics and advantages of the present invention will become more apparent from the following detailed description of the example embodiments with reference to the attached drawings.

BRIEF DESCRIPTION OF THE DRAWINGS

A more complete appreciation of example embodiments of the present invention and many of the attendant advantages thereof will be readily obtained as the same becomes better understood by reference to the following detailed description when considered in connection with the accompanying drawings described below.

FIG. 10 is a perspective view illustrating a rotator, an insert, a holder, a fastening, a blade body, and the like.

FIG. 11 is a perspective view illustrating the insert, the holder, the fastening, the blade body, and the like.

DETAILED DESCRIPTION OF THE EXAMPLE EMBODIMENTS

Figure 1:
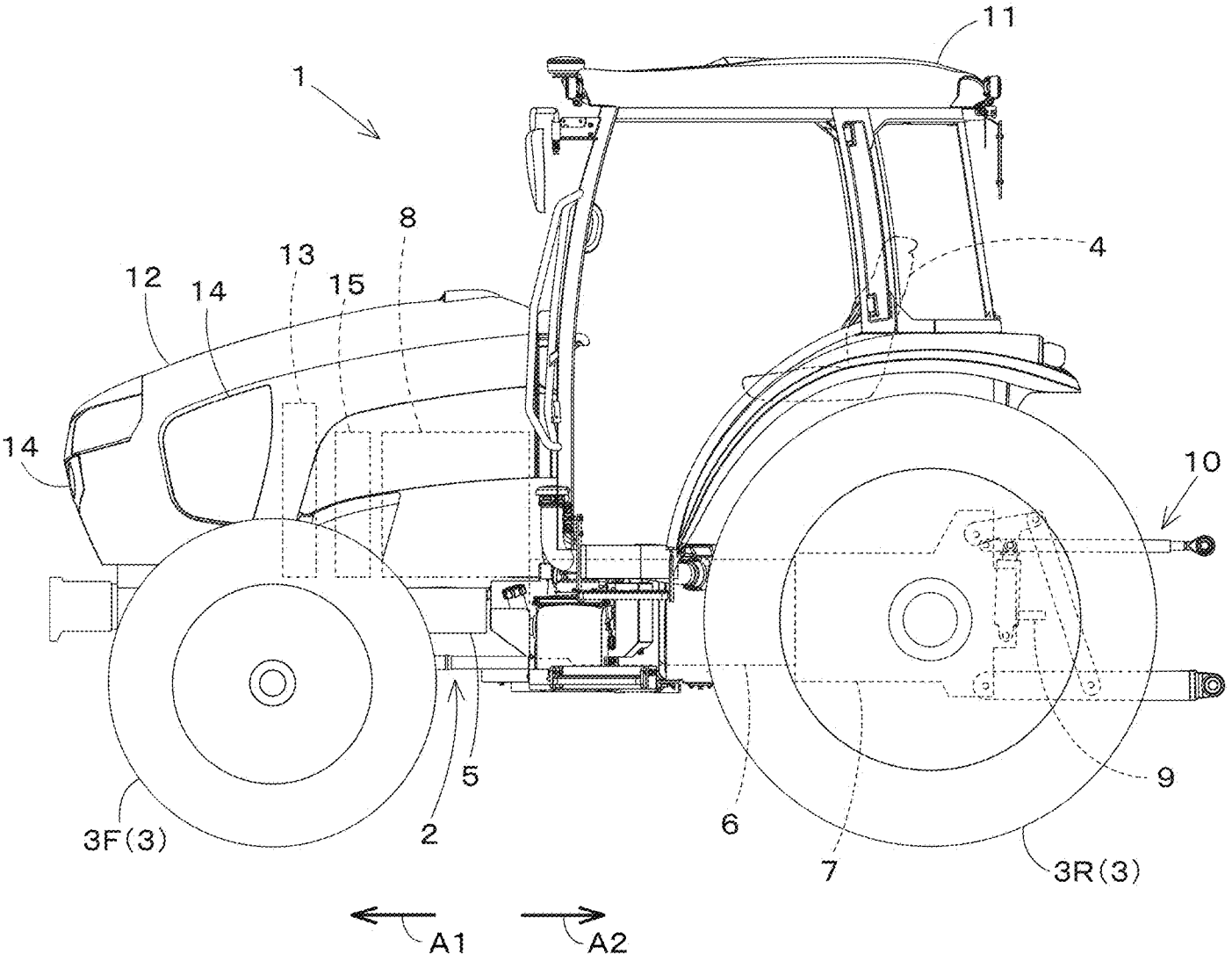
FIG. 1 is a side view illustrating an example of a working machine.

Example embodiments will now be described with reference to the accompanying drawings, wherein like reference numerals designate corresponding or identical elements throughout the various drawings. The drawings are to be viewed in an orientation in which the reference numerals are viewed correctly.

Example embodiments of working machines according to the present invention are described below. FIG. 1 is a side view illustrating an example of a working machine 1 according to an example embodiment of the present invention. The working machine 1 illustrated in FIG. 1 is a tractor. However, the working machines according to example embodiments of the present invention are not limited to the tractor. For example, the working machine 1 may be another agricultural machine such as a harvester typified by a combine, a paddy farming machine, a transplanter, or a mower, may be a construction machine such as a backhoe or a loader, or may be a working machine that performs other work. The following description is directed to the exemplary case where the working machine 1 is the tractor.

The working machine 1 includes a machine body (vehicle body) 2 and a traveling device 3 that supports the machine body 2 in a travelable manner. An operator's seat 4 is mounted on the machine body 2. Hereinafter, a front refers to the forward of an operator sitting on the operator's seat 4 of the working machine 1 (arrow A1 direction in FIG. 1), a rear refers to the rearward of the operator (arrow A2 direction in FIG. 1), a left refers to the leftward of the operator (front side of the drawing sheet of FIG. 1), and a right refers to the rightward of the operator (back side of the drawing sheet of FIG. 1).

The machine body 2 includes a body frame 5, a clutch housing 6, and a transmission case 7. The body frame 5 extends in a front-rear direction of the machine body 2. An engine 8 is mounted on the body frame 5. The clutch housing 6 is connected to the rear of the engine 8, and houses a clutch. The transmission case 7 is coupled to the rear of the clutch housing 6, and houses a transmission, a rear wheel differential, and the like. A PTO shaft 9 is provided to the rear of the machine body 2 (rear of the transmission case 7) to protrude rearward.

The traveling device 3 includes front wheels 3F provided to the front of the machine body 2, and rear wheels 3R provided to the rear of the machine body 2. The front wheels 3F are supported by the body frame 5. The rear wheels 3R are supported by an output shaft of the rear wheel differential. In the present example embodiment, the rear wheels 3R are tires, but may be crawler traveling devices.

A coupler 10 is provided to the rear of the machine body 2. The coupler 10 is a portion to couple a working device that performs work in an agricultural field or the like to the rear of the working machine 1. In the present example embodiment, the coupler 10 includes a three-point linkage. The working device is driven by a driving force transmitted from the PTO shaft 9. For example, the working device is a cultivator, a spreader, or a seeder, but is not limited thereto.

A cabin 11 surrounding the operator's seat 4 is mounted on the machine body 2. A hood 12 is provided forward of the cabin 11. The engine 8 is provided inside the hood 12. For example, the engine 8 is a water-cooled diesel engine. A radiator 13 to cool a coolant of the engine 8 is provided forward of the engine 8. A fan 15 is connected to a rotation shaft 8*a* protruding forward from the engine 8. The fan 15 is rotated by power of the engine 8.

Dustproof covers 14 with dustproof nets are provided to the sides and front of the hood 12. The fan 15 can generate an airflow to cool apparatuses (engine 8, radiator 13) mounted inside the machine body 2 (hereinafter referred to as "normal airflow"), and an airflow in a direction different from the direction of that airflow. The airflow in a direction different from the direction of the normal airflow is, for example, an airflow in a direction opposite to the direction of the normal airflow (hereinafter referred to as "reverse airflow").

When the fan 15 generates the normal airflow, air outside the hood 12 is introduced into the hood 12 through the dustproof cover 14 by the normal airflow to cool the radiator 13 and the engine 8. When the fan 15 generates the reverse airflow, air inside the hood 12 is discharged out of the hood 12 through the dustproof cover 14 by the reverse airflow. Thus, dust that clogs the mesh of the dustproof cover 14 can be removed by blowing the dust away.

As described above, the working machine 1 includes the fan 15 that can generate the airflow to cool the apparatuses (engine 8, radiator 13) mounted inside the machine body 2 (normal airflow) and the airflow in a direction different from the direction of that airflow (reverse airflow or the like). The structure of the fan 15 is described in detail below with reference to FIGS. 2 to 8 and the like.

Figure 6:
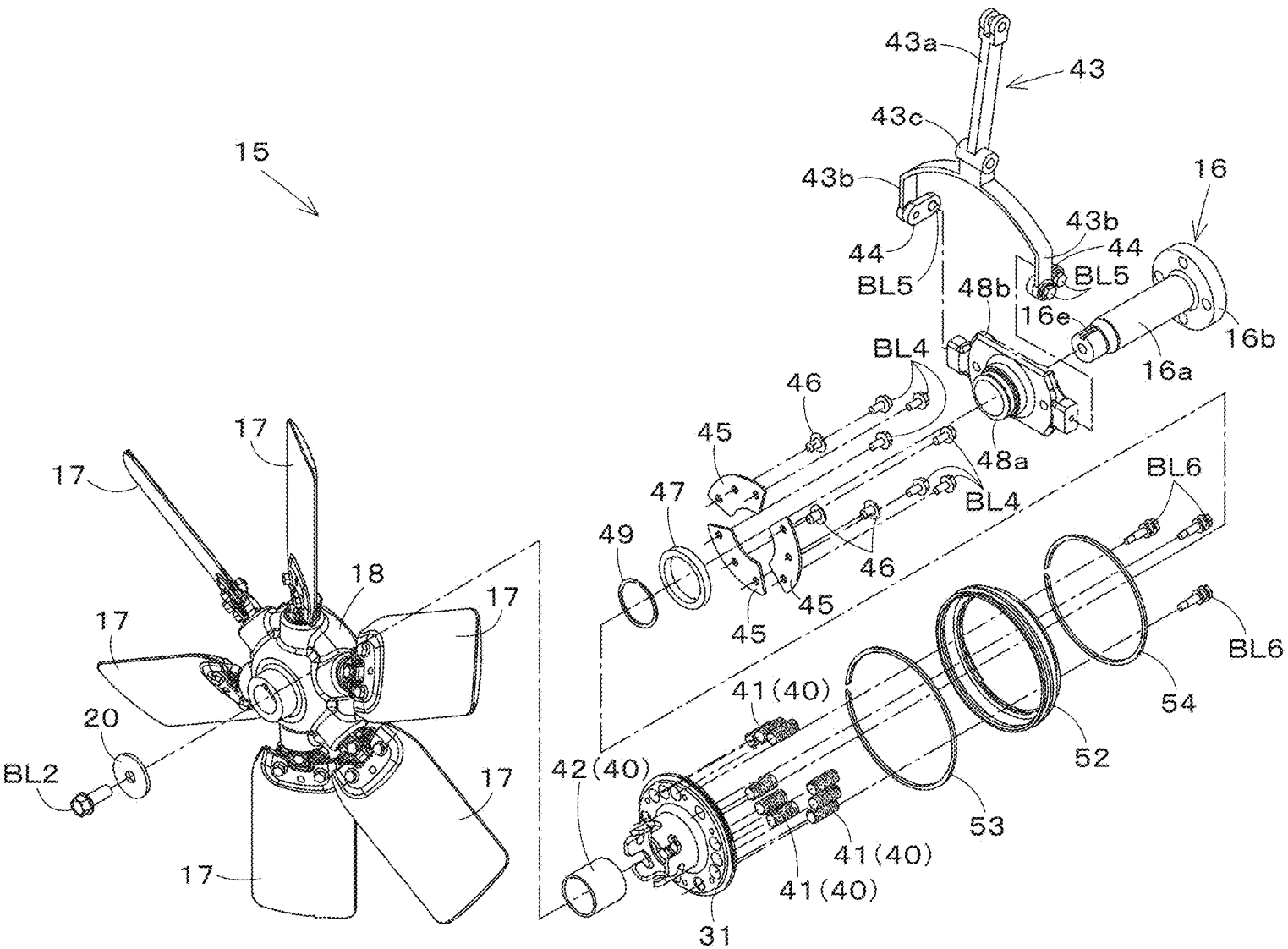
FIG. 6 is an exploded perspective view of the fan.

The fan 15 includes a central shaft 16 that rotates about an axis. An axis X1 (see FIG. 7) of the central shaft 16 extends in the front-rear direction. Therefore, the central shaft 16 rotates about the axis X1 extending in the front-rear direction. As illustrated in FIG. 6 and the like, the central shaft 16 includes a column 16*a* extending in the front-rear direction, and a disc 16*b* provided to the rear end of the column 16*a*. The outer diameter of the disc 16*b* is larger than the outer diameter of the column 16*a*.

Figure 4:
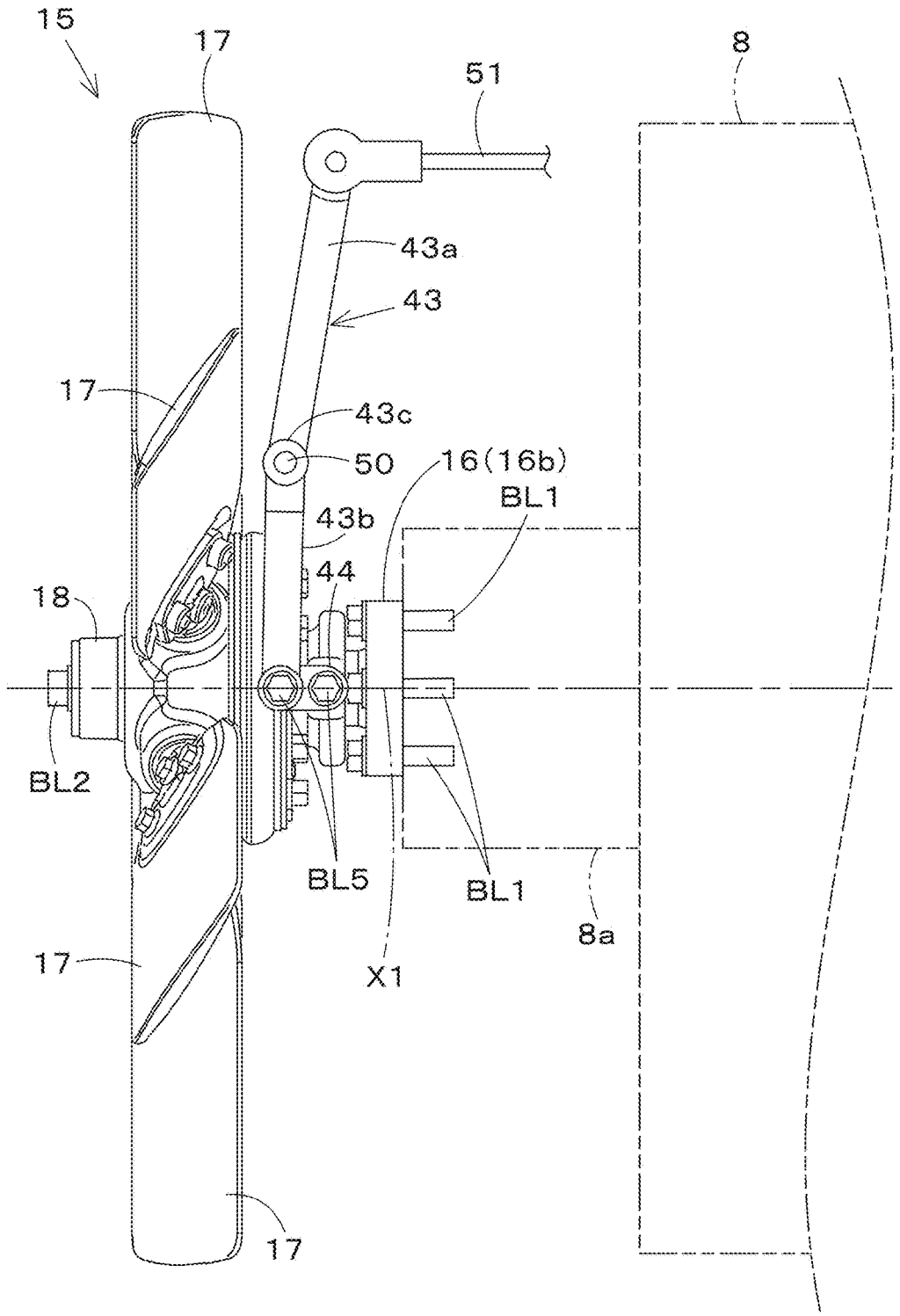
FIG. 4 is a side view of the fan.
Figure 5:
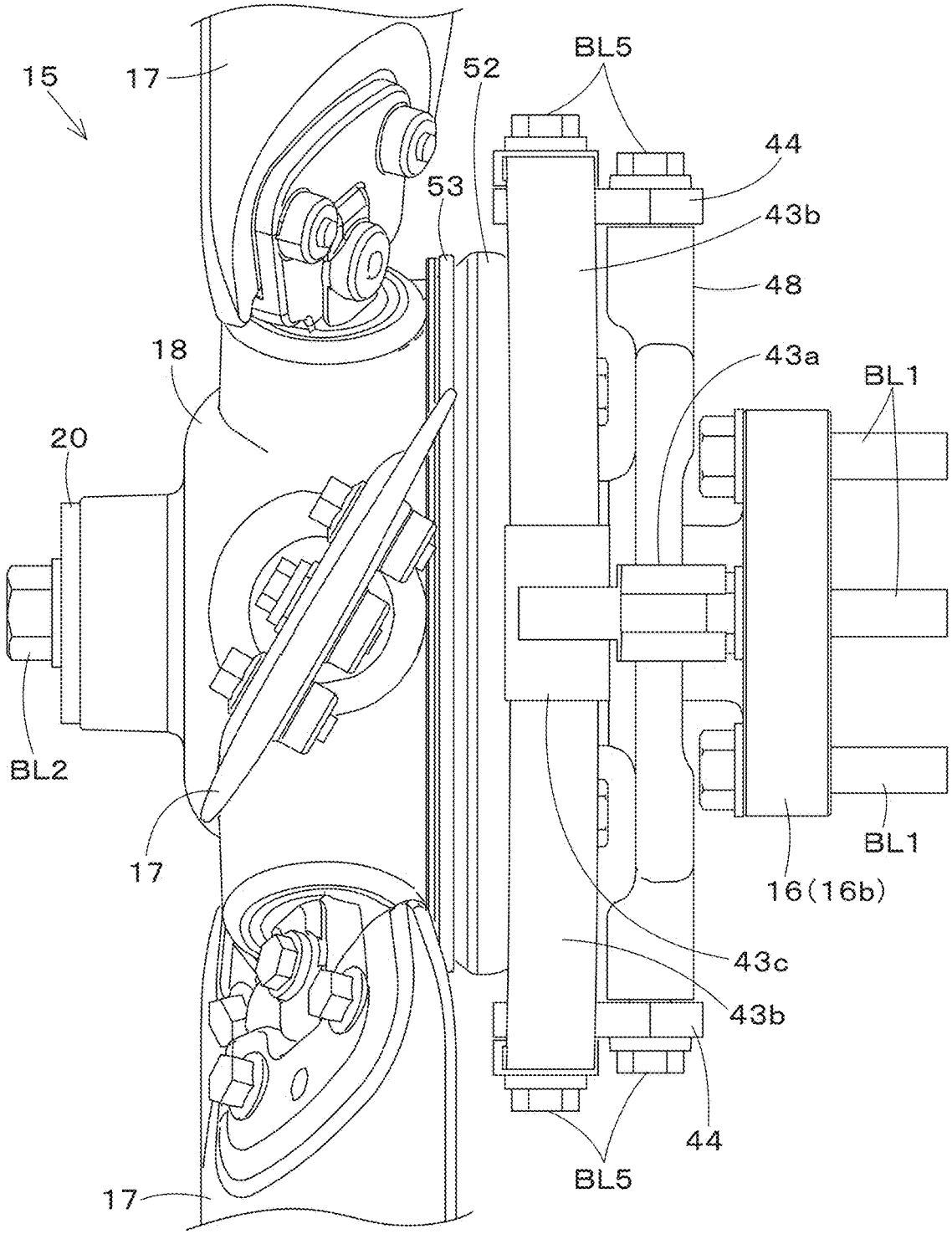
FIG. 5 is a plan view of the fan.

As illustrated in FIG. 4, the disc 16*b* is connected to the rotation shaft 8*a* protruding forward from the engine 8 with bolts BL1. The disc 16*b* may be connected directly to the rotation shaft 8*a* or indirectly to the rotation shaft 8*a* via another structure or apparatus. That is, the disc 16*b* is connected directly or indirectly to the rotation shaft 8*a* of the engine 8 so that rotation power of the rotation shaft 8*a* is transmitted. Thus, the rotation power of the engine 8 is transmitted to the central shaft 16, and the central shaft 16 rotates about the axis X1 extending in the front-rear direction.

The fan 15 includes a plurality of rotary blades 17 extending in a radial direction of the central shaft 16. The radial direction of the central shaft 16 is a direction orthogonal to and away from the axis X1 (arrow B1 direction in FIG. 8). In the following description, the radial direction of the central shaft 16 may be referred to as "central shaft radial direction."

Figure 8:
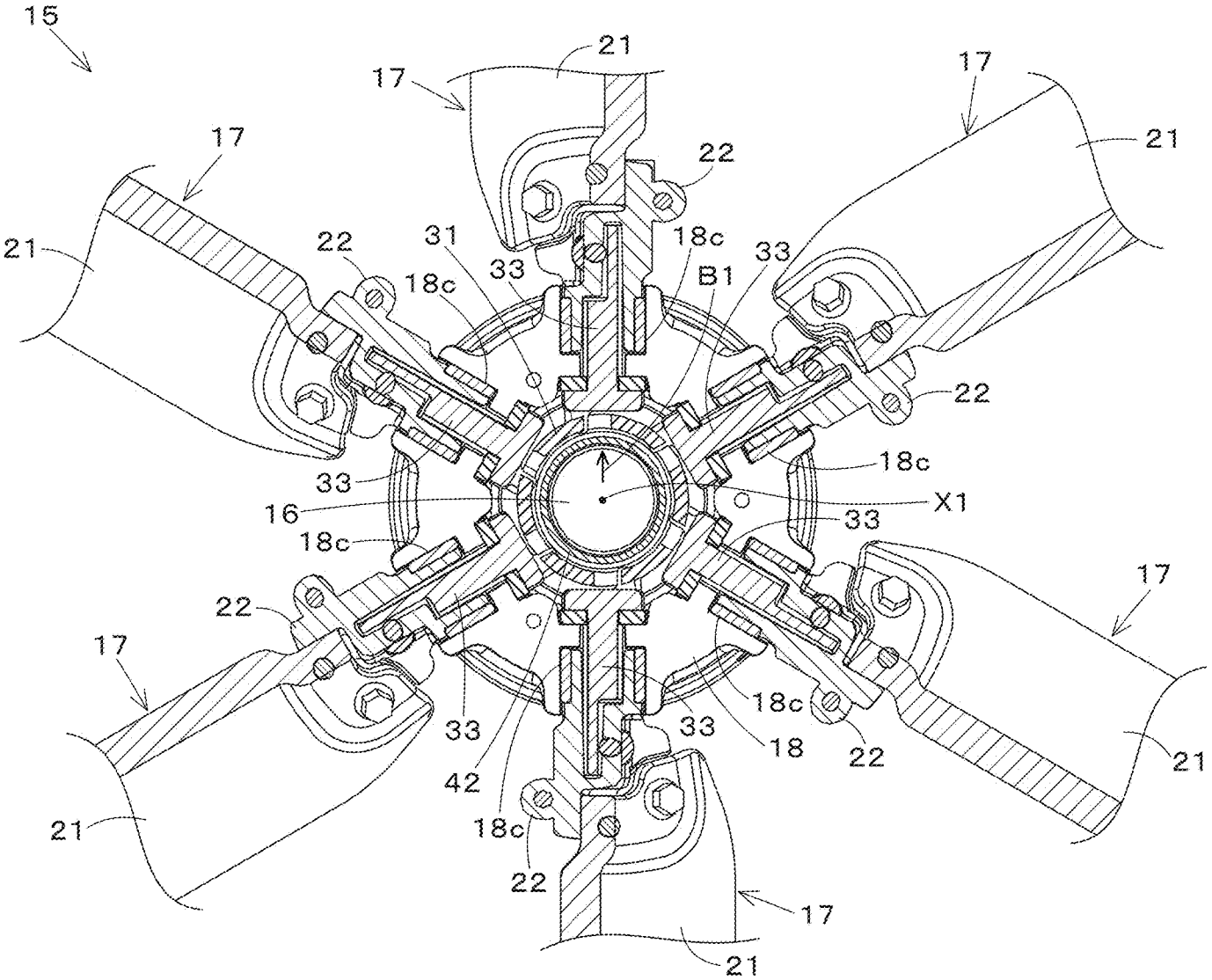
FIG. 8 is a sectional view cut along a plane orthogonal to an axis of a central shaft of the fan.

As illustrated in FIG. 8, the plurality of rotary blades 17 is provided around the central shaft 16. In the present example embodiment, the number of the rotary blades 17 is six. However, the number of the rotary blades 17 is not limited to six, and may be larger or smaller than six. The plurality of rotary blades 17 radially extends in the radial direction of the central shaft 16. The plurality of rotary blades 17 is attached to a rotator 18.

Figure 7:
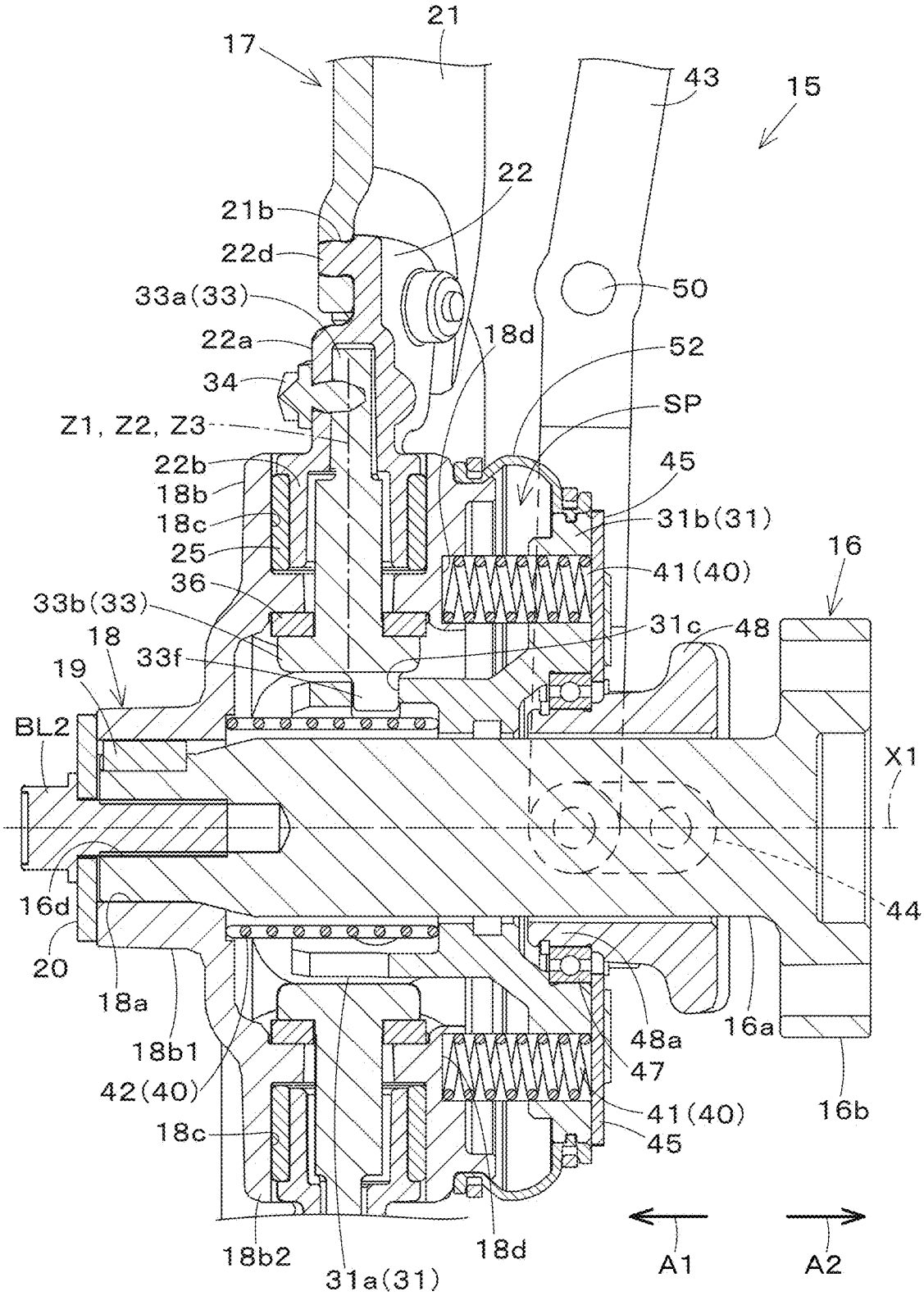
FIG. 7 is a sectional view of the fan cut in a vertical direction at the center in a lateral direction (in a state in which at least one rotary blade is in a reverse flow position).
Figure 9:
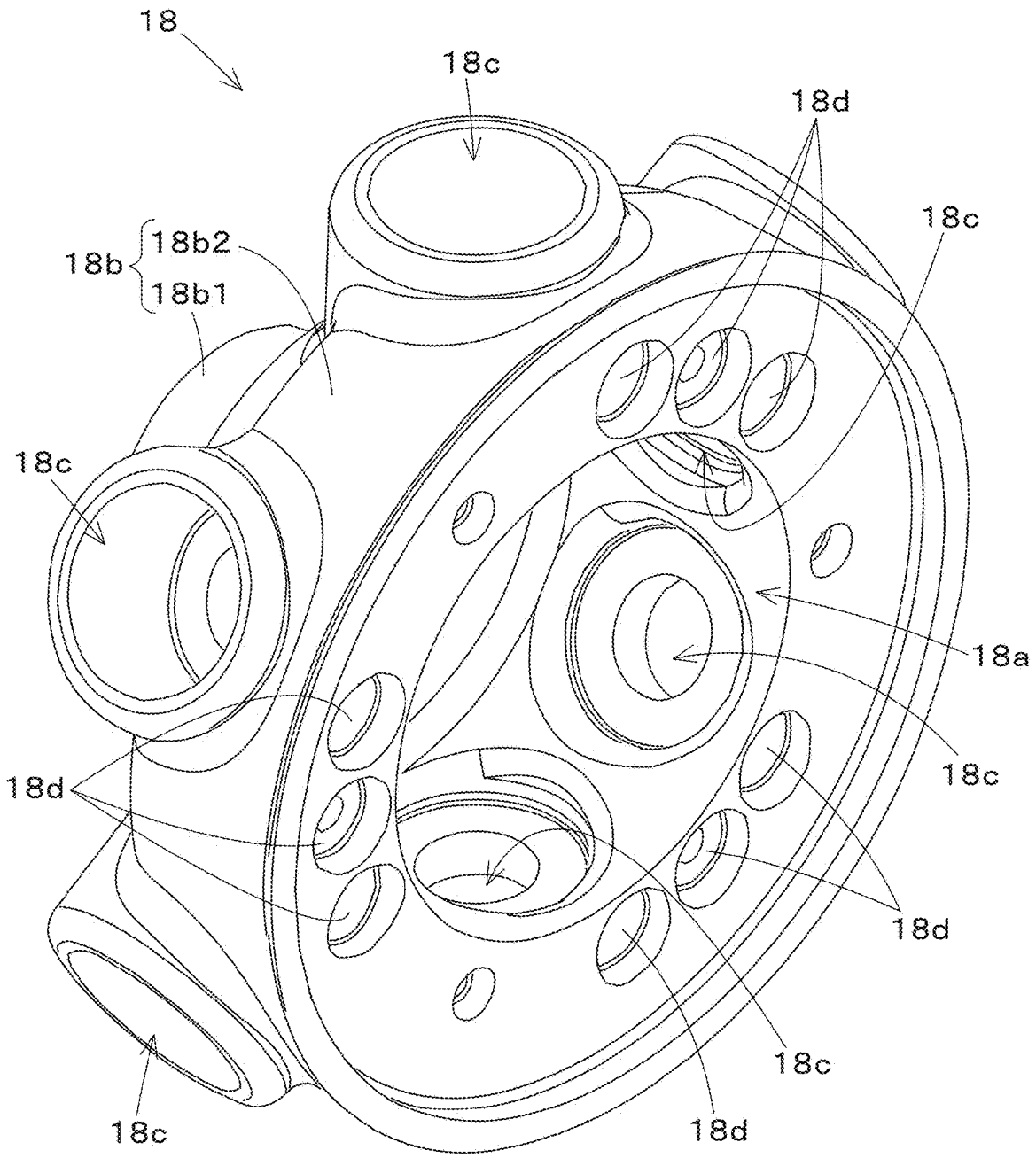
FIG. 9 is a rear perspective view of a rotator.

The rotator 18 is rotatable together with the central shaft 16. As illustrated in FIGS. 7 and 9, a through hole 18*a* is provided at the center of the rotator 18. The through hole 18*a* extends through the rotator 18 in the front-rear direction. The column 16*a* of the central shaft 16 is inserted through the through hole 18*a*. The rotator 18 and the central shaft 16 are coupled by a key groove 18*f* (see FIG. 10) in the inner peripheral surface of the rotator 18, a key groove 16*e* (see FIG. 6) in the outer peripheral surface of the central shaft 16, and a key 19 (see FIG. 7) inserted into the key grooves 18*f* and 16*e*. Thus, the rotator 18 rotates about the axis X1 of the central shaft 16 along with rotation of the central shaft 16.

Figure 10:
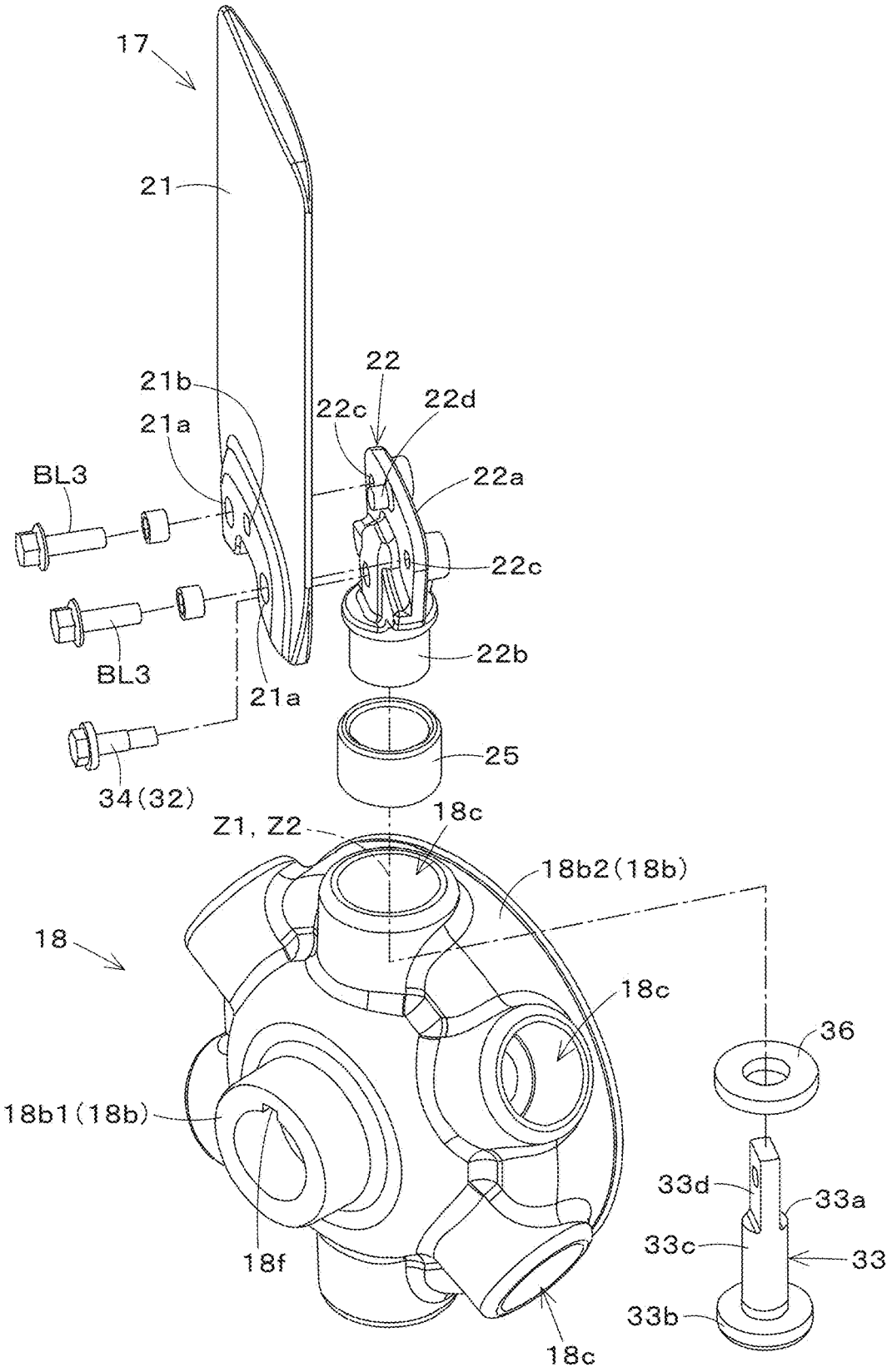

As illustrated in FIGS. 7, 9, 10, and the like, the rotator 18 includes a tubular portion 18*b* provided around the central shaft 16, and at least one insertion opening 18*c* at the outer periphery of the tubular portion 18*b*. The tubular portion 18*b* includes a small diameter portion 18*b*1 and a large diameter portion 18*b*2. The small diameter portion 18*b*1 is provided at the front of the rotator 18. The large diameter portion 18*b*2 is provided at the rear of the rotator 18 (rearward of the small diameter portion 18*b*1).

Figure 2:
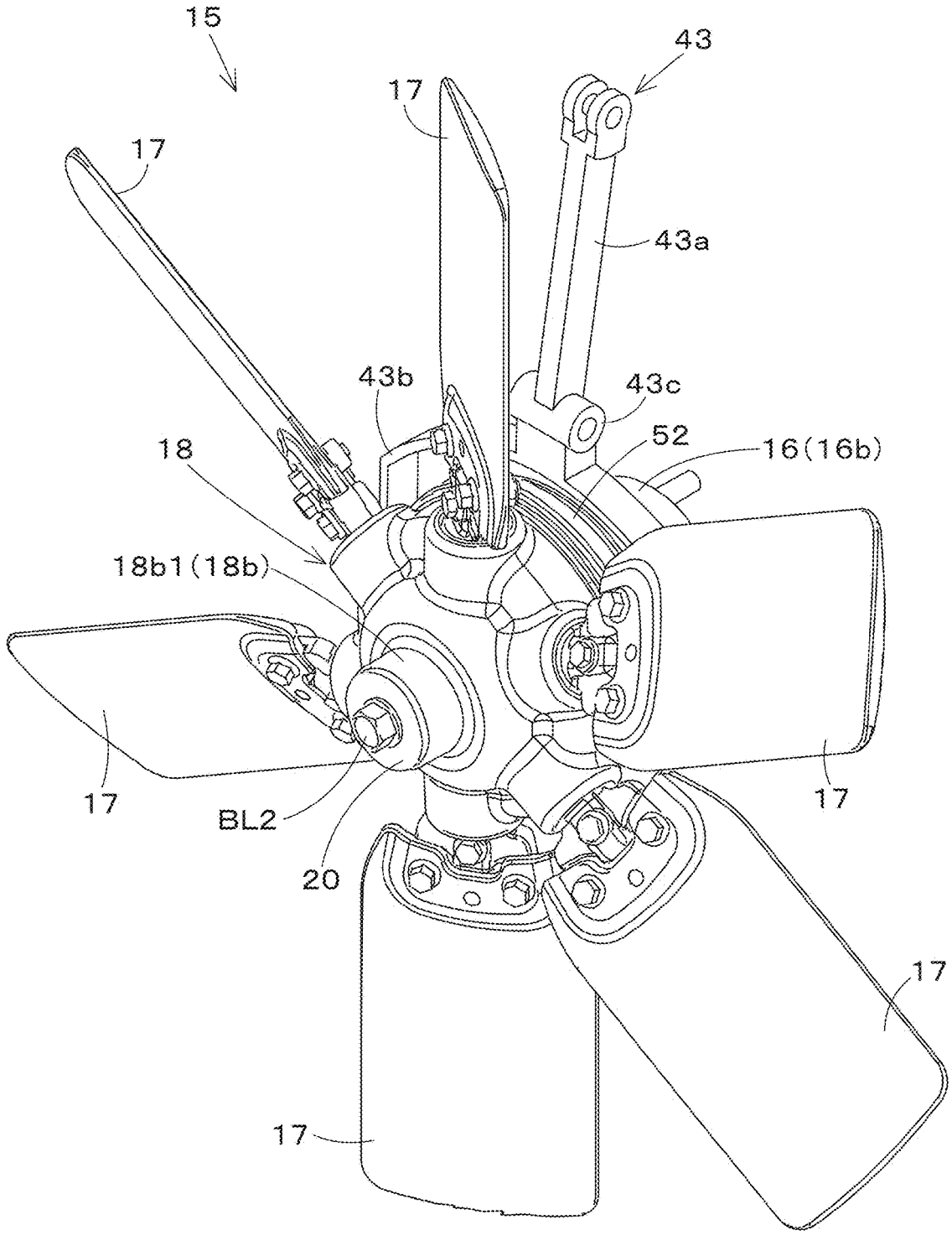
FIG. 2 is a front perspective view of a fan.

The key groove 18*f* described above is provided in the inner peripheral surface of the small diameter portion 18*b*1. As illustrated in FIGS. 2, 7, and the like, an annular plate 20 abuts against the front end surface of the small diameter portion 18*b*1. A bolt BL2 is inserted into the annular plate 20 from the front. The bolt BL2 threadedly engages with a screw hole 16*d* in the column 16*a* of the central shaft 16. Thus, detachment of the central shaft 16 from the rotator 18 is prevented.

As illustrated in FIGS. 9, 10, and the like, the insertion opening 18*c* is provided at the outer periphery of the large diameter portion 18*b*2 of the tubular portion 18*b*. The insertion opening 18*c* extends in the central shaft radial direction (radial direction of the central shaft 16) from the outer peripheral surface of the large diameter portion 18*b*2. As illustrated in FIG. 8, a plurality of insertion openings 18*c* is provided at regular intervals along the outer peripheral surface of the rotator 18. The number of the insertion openings 18*c* is equal to the number of the rotary blades 17. Therefore, the number of the insertion openings 18*c* is six in the present example embodiment.

The insertion opening 18*c* defines a columnar space. As illustrated in FIGS. 7, 8, 10, and the like, a proximal end portion of the rotary blade 17 (holder 22 described later) is inserted into the insertion opening 18*c*. Thus, the rotary blade 17 is attached to the insertion opening 18*c* of the rotator 18, and rotates together with the rotator 18 along with rotation of the central shaft 16.

Figure 11:
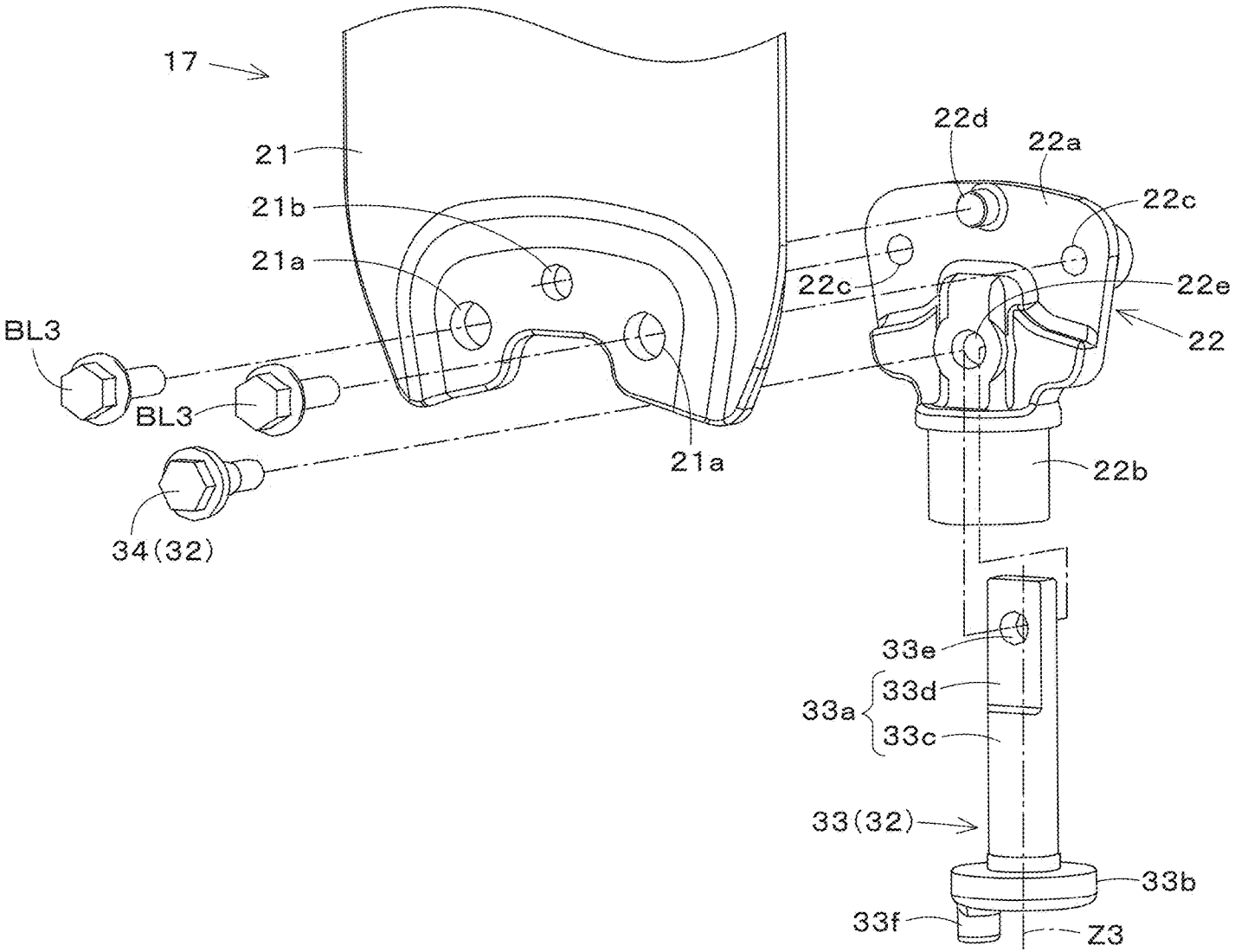

As illustrated in FIGS. 10 and 11, the rotary blade 17 includes a blade body 21 and the holder 22. The blade body 21 is a plate-shaped structure that generates airflow by rotating together with the central shaft 16. A first attachment hole 21*a* and a second attachment hole 21*b* are provided at the proximal end of the blade body 21. The holder 22 is configured to hold the proximal end (near the central shaft 16) of the blade body 21. The holder 22 includes a flat portion 22*a* and a cylindrical portion 22*b*. The flat portion 22*a* has a screw hole 22*c* and a projection 22*d*. The blade body 21 and the holder 22 are fixed by inserting the projection 22*d* into the second attachment hole 21*b* and threadedly engaging a bolt BL3 inserted through the first attachment hole 21*a* with the screw hole 22*c*.

As illustrated in FIGS. 7, 10, and the like, the cylindrical portion 22*b* of the holder 22 is inserted into the insertion opening 18*c* of the rotator 18. A radial bearing 25 is interposed between the outer peripheral surface of the cylindrical portion 22*b* and the inner peripheral surface of the insertion opening 18*c*. Thus, the holder 22 can rotate about a center axis Z1 of the insertion opening 18*c* relative to the rotator 18. The blade body 21 also rotates along with the rotation of the holder 22. Therefore, the rotary blade 17 can rotate about the center axis Z1 of the insertion opening 18*c* relative to the rotator 18.

The fan 15 includes an angle change mechanism that changes the angle of the rotary blade 17 relative to the central shaft 16. The angle change mechanism is configured to change the angle of the rotary blade 17 relative to the central shaft 16 by turning the rotary blade 17 about an axis Z2 (see FIGS. 7 and 10) corresponding to an axis in the radial direction of the central shaft 16 (central shaft radial direction). The "axis Z2 corresponding to an axis in the radial direction of the central shaft 16" is hereinafter referred to as "radial axis Z2." The radial axis Z2 agrees with the center axis Z1 of the insertion opening 18*c*. Therefore, the angle change mechanism is rephrased as a mechanism that turns the rotary blade 17 about the center axis Z1 of the insertion opening 18*c* relative to the rotator 18.

The angle change mechanism includes a movable body 31 (see FIGS. 6, 7, and the like) movable in the axial direction of the central shaft 16 (front-rear direction), and a conversion mechanism (described later) that converts movement of the movable body 31 into turn of the rotary blade 17. The movable body 31 moves in the front-rear direction relative to the rotator 18. The position of the movable body 31 in the front-rear direction relative to the rotator 18 is changed by the movement.

Figure 12:
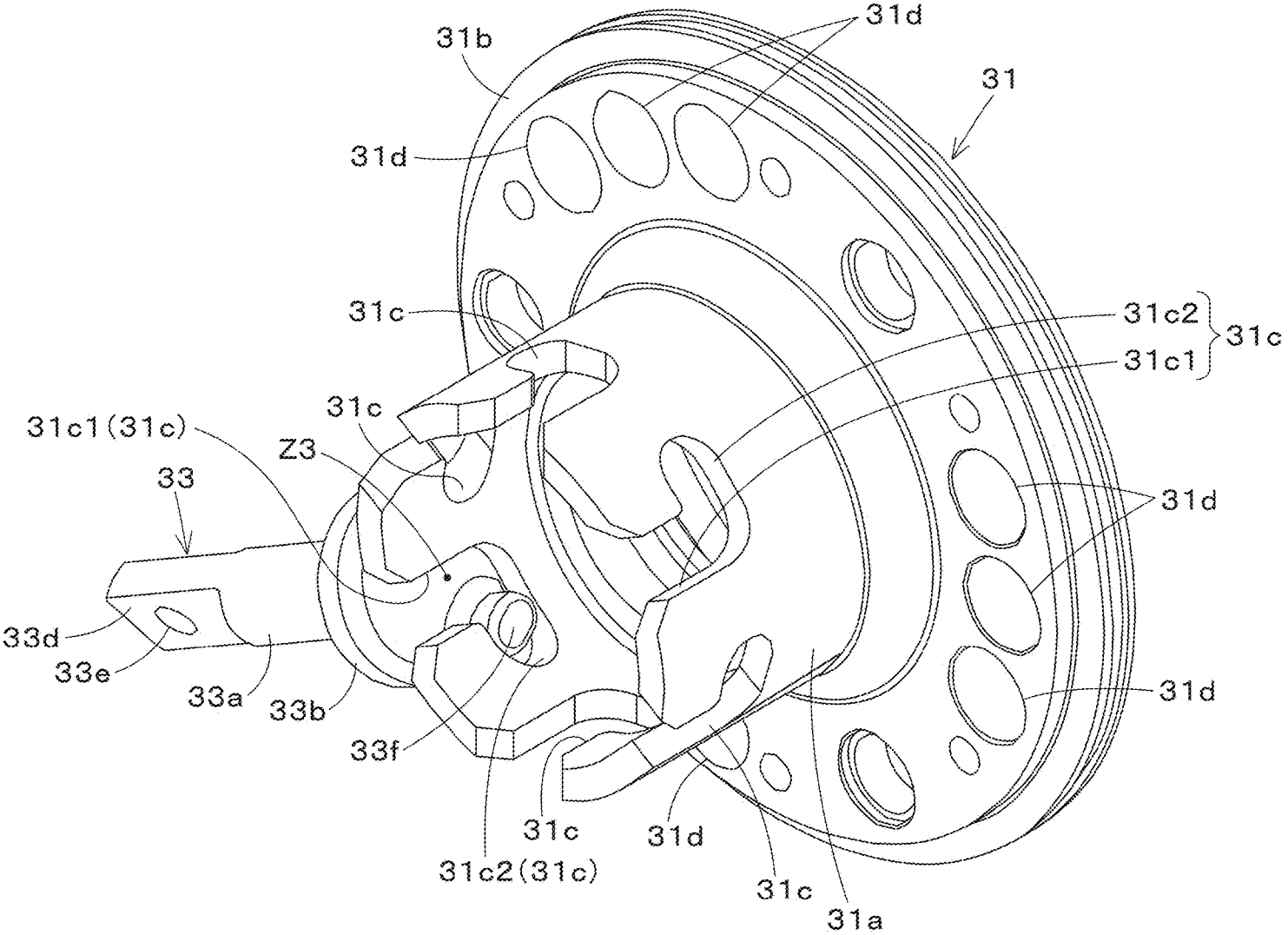
FIG. 12 is a front perspective view of a movable body, illustrating a state in which a protrusion is inserted into one engagement groove.

As illustrated in FIG. 12 and the like, the movable body 31 includes a cylindrical portion 31*a* and a flange portion 31*b*. The cylindrical portion 31*a* and the flange portion 31*b* are integral with each other. The cylindrical portion 31*a* is provided around the central shaft 16 (see FIG. 7). The flange portion 31*b* is provided rearward of the cylindrical portion 31*a*. The flange portion 31*b* has a ring shape with a larger diameter than the cylindrical portion 31*a*.

The cylindrical portion 31*a* has at least one engagement groove 31*c* with which a protrusion 33*f* described later engages. A plurality of engagement grooves 31*c* are provided at regular intervals in a circumferential direction of the cylindrical portion 31*a*. The number of the engagement grooves 31*c* is equal to the number of the rotary blades 17. Since the number of the rotary blades 17 is six in the present example embodiment, the number of the engagement grooves 31*c* is also six.

The engagement groove 31*c* includes a first groove portion 31*c*1 extending in a direction parallel or substantially parallel to the central shaft 16 (front-rear direction), and a second groove portion 31*c*2 continuous with the first groove portion 31*c*1 and extending in the circumferential direction of the cylindrical portion 31*a*. The engagement groove 31*c* has an L-shape including the first groove portion 31*c*1 and the second groove portion 31*c*2. The first groove portion 31*c*1 extends rearward from the front end of the cylindrical portion 31*a*. The second groove portion 31*c*2 is bent from the rear end of the first groove portion 31*c*1, and extends clockwise in a rear view. Depending on the rotation direction of the fan 15, the second groove portion 31*c*2 may be bent from the rear end of the first groove portion 31*c*1, and extend counterclockwise in a rear view.

The conversion mechanism to convert movement of the movable body 31 into turning of the rotary blade 17 includes an insert 33, a fastening 34, and a turning mechanism (described later). As illustrated in FIGS. 7 and 8, the insert 33 is inserted into the rotary blade 17 in the central shaft radial direction. As illustrated in FIGS. 10 and 11, the insert 33 includes a shaft portion 33*a* and a head portion 33*b*. As illustrated in FIG. 7, the shaft portion 33*a* is inserted into the holder 22. The flat portion 22*a* of the holder 22 has an internal space that communicates with the internal space of the cylindrical portion 22*b*.

As illustrated in FIG. 11, the shaft portion 33*a* includes a column 33*c* and a flat plate 33*d*. The flat plate 33*d* is provided at the distal end of the shaft portion 33*a*. The flat plate 33*d* has a first through hole 33*e*. The flat plate 33*d* is inserted into the internal space of the flat portion 22*a* of the holder 22. The column 33*c* is inserted into the internal space of the cylindrical portion 22*b* of the holder 22. Thus, as illustrated in FIG. 7, the shaft portion 33*a* of the insert 33 is inserted into both the internal space of the cylindrical portion 22*b* and the internal space of the flat portion 22*a*.

The head portion 33*b* of the insert 33 is provided at the proximal end of the shaft portion 33*a*. As illustrated in FIG. 7, the head portion 33*b* is provided at the end of the shaft portion 33*a* near the central shaft 16. The head portion 33*b* is provided outside the holder 22. Specifically, the head portion 33*b* is provided outside the holder 22 and outward of the cylindrical portion 31*a* of the movable body 31. In other words, the head portion 33*b* is provided between the holder 22 and the cylindrical portion 31*a* in the central shaft radial direction.

As illustrated in FIG. 11, the insert 33 includes the protrusion 33*f*. The protrusion 33*f* is integral with the head portion 33*b*. The protrusion 33*f* protrudes from the head portion 33*b* toward the central shaft 16 (see FIG. 7). The protrusion 33*f* is in the shape of an elliptical column. The protrusion 33*f* is provided at a position offset from an axis Z3 of the insert 33 (axis of the column 33*c*) (see FIGS. 11 to 13).

Figure 20:
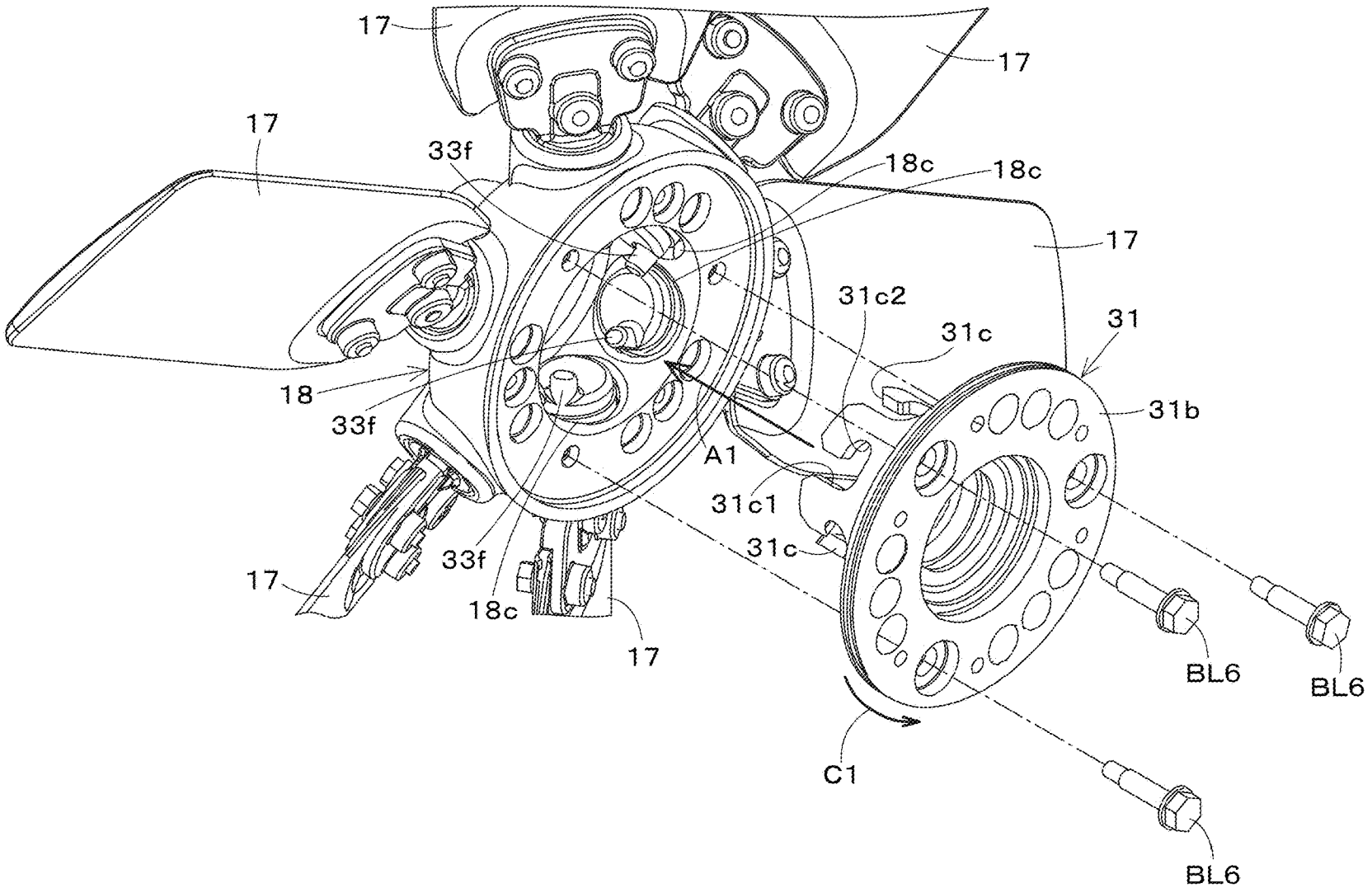
FIG. 20 is a diagram illustrating a method for attaching the movable body to the rotator.

The axis Z3 of the insert 33 agrees with the center axis Z1 of the insertion opening 18*c* and the radial axis Z2 in a state in which the proximal end of the rotary blade 17 is inserted into the insertion opening 18*c* (see FIG. 7). In the state in which the proximal end of the rotary blade 17 is inserted into the insertion opening 18*c*, the protrusion 33*f* protrudes inward (toward the central shaft 16) from the insertion opening 18*c* (see FIGS. 7 and 20).

As illustrated in FIGS. 7 and 10, a thrust bearing 36 is attached to the outer peripheral surface of the shaft portion 33*a*. The thrust bearing 36 abuts against the surface of the head portion 33*b* opposite to the protrusion 33*f*. One surface of the thrust bearing 36 abuts against the surface of the head portion 33*b* opposite to the protrusion 33*f*, and the other surface of the thrust bearing 36 abuts against the inner surface of the rotator 18.

Therefore, the head portion 33*b* can smoothly rotate relative to the rotator 18 (about the center axis Z1 of the insertion opening 18*c*), and the insert 33 can smoothly rotate relative to the rotator 18. As a result, the rotary blade 17 can smoothly rotate relative to the rotator 18 about the center axis Z1 of the insertion opening 18*c* (and about the radial axis Z2).

The thrust bearing 36 can receive a force acting in the axial direction of the shaft portion 33*a* (central shaft radial direction), and the radial bearing 25 can receive a force acting in the radial direction of the shaft portion 33*a*. Thus, the forces in the two directions on the insert 33 can be received by the bearings (radial bearing 25 and thrust bearing 36). Therefore, when a force acts on the insert 33, hindrance of rotation of the insert 33 due to the force can be prevented.

As illustrated in FIG. 11, the fastening 34 is a structure that fixes the rotary blade 17 and the insert 33. Specifically, the fastening 34 is a structure that fixes the holder 22 of the rotary blade 17 and the shaft portion 33*a* of the insert 33. The fastening 34 is a bolt, for example. Specifically, the fastening 34 is a reamer bolt, for example.

Figure 14:
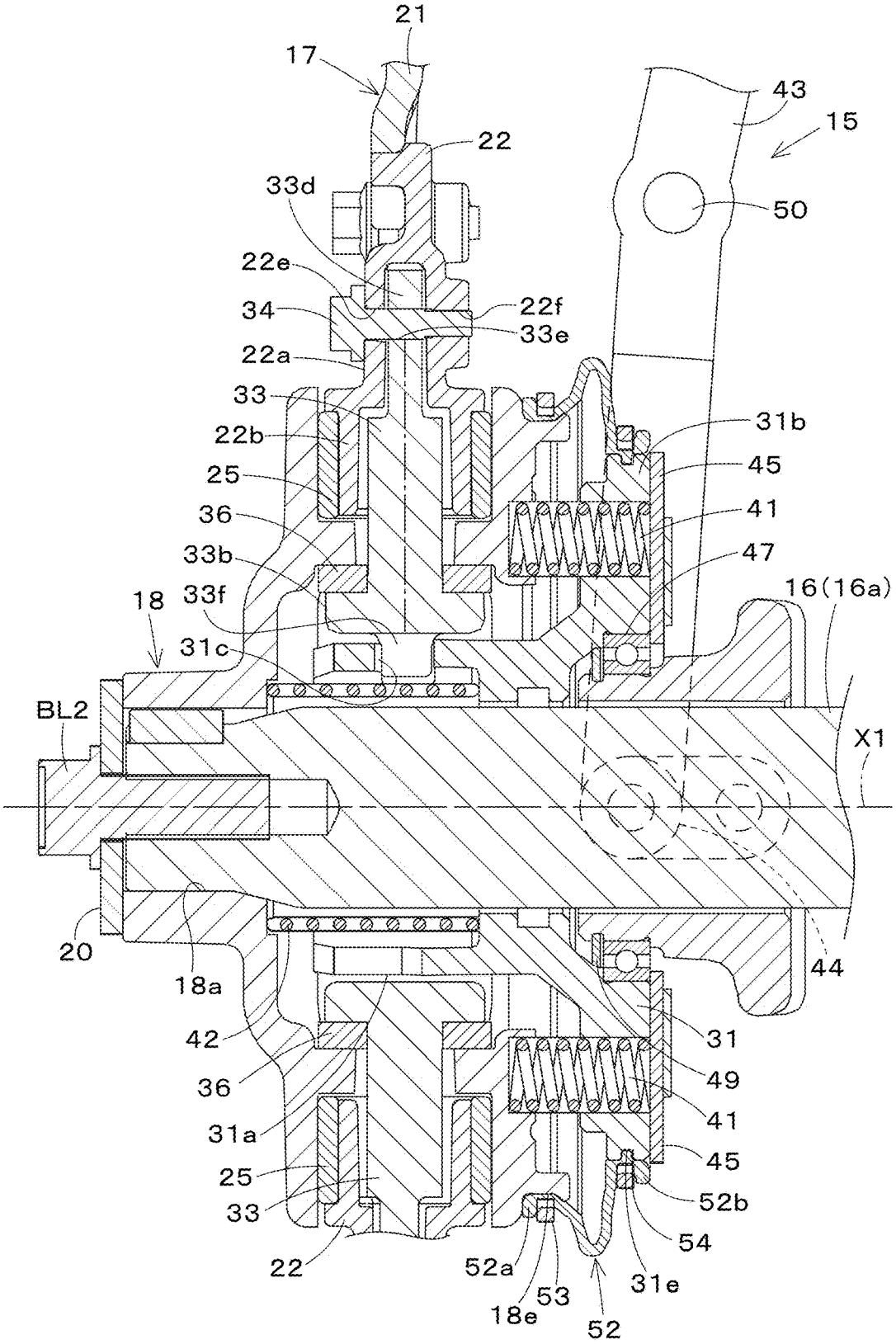
FIG. 14 is an enlarged view of a main portion of FIG. 18.

As illustrated in FIG. 14, when the rotary blade 17 is in a neutral position described later, the fastening 34 extends in a direction parallel or substantially parallel to the central shaft 16. When the rotary blade 17 is in a reverse flow position (see FIG. 7) or a normal flow position (see FIG. 19) described later, the fastening 34 extends in a direction different from the direction parallel or substantially parallel to the central shaft 16. When the rotary blade 17 is in the normal flow position or the reverse flow position, the direction in which the fastening 34 extends is twisted from the axis X1 of the central shaft 16. Irrespective of whether the rotary blade 17 is in the neutral position, the normal flow position, or the reverse flow position, the direction in which the fastening 34 extends does not intersect the axis X1 of the central shaft 16.

As illustrated in FIG. 14, the flat portion 22*a* of the holder 22 has a second through hole 22*e* and a screw hole 22*f*. The fastening 34 is inserted through the first through hole 33*e* of the insert 33 and the second through hole 22*e* of the holder 22. The bolt (reamer bolt) that is the fastening 34 is inserted from the second through hole 22*e* of the flat portion 22*a*, passes through the first through hole 33*e* in the flat plate 33*d* of the insert 33, and screwed in the screw hole 22*f* of the flat portion 22*a*. Thus, the holder 22 and the insert 33 are fixed in the central shaft radial direction, and the rotary blade 17 and the insert 33 are fixed.

The turning mechanism turns the insert 33 about the axis Z2 (see FIG. 7) corresponding to the axis in the central shaft radial direction along with movement of the movable body 31. The turning mechanism includes the protrusion 33*f* and the engagement groove 31*c* described above. As described above, the protrusion 33*f* is included in the insert 33, and the engagement groove 31*c* is provided in the movable body 31. The protrusion 33*f* engages with the engagement groove 31*c* by being inserted into the engagement groove 31*c* (see FIGS. 7, 12 to 14, and the like).

The movable body 31 is movable in a first direction (forward) that is one direction of the axial direction of the central shaft 16 (front-rear direction), and in a second direction (rearward) that is the other direction of the axial direction. In FIG. 7, the arrow A1 direction is the first direction (forward), and the arrow A2 direction is the second direction (rearward). That is, the movable body 31 is movable in the arrow A1 direction and the arrow A2 direction in FIG. 7.

As illustrated in FIGS. 6 and 7, the angle change mechanism includes a spring 40 to bias the movable body 31 in the second direction A2, and an actuator 43 to move the movable body 31 in the first direction A1 against the biasing force of the spring 40. The spring 40 includes at least one first spring 41 and a second spring 42. The first spring 41 and the second spring 42 are cylindrical coil springs. The diameter of the second spring 42 is larger than the diameter of the first spring 41.

Figure 15:
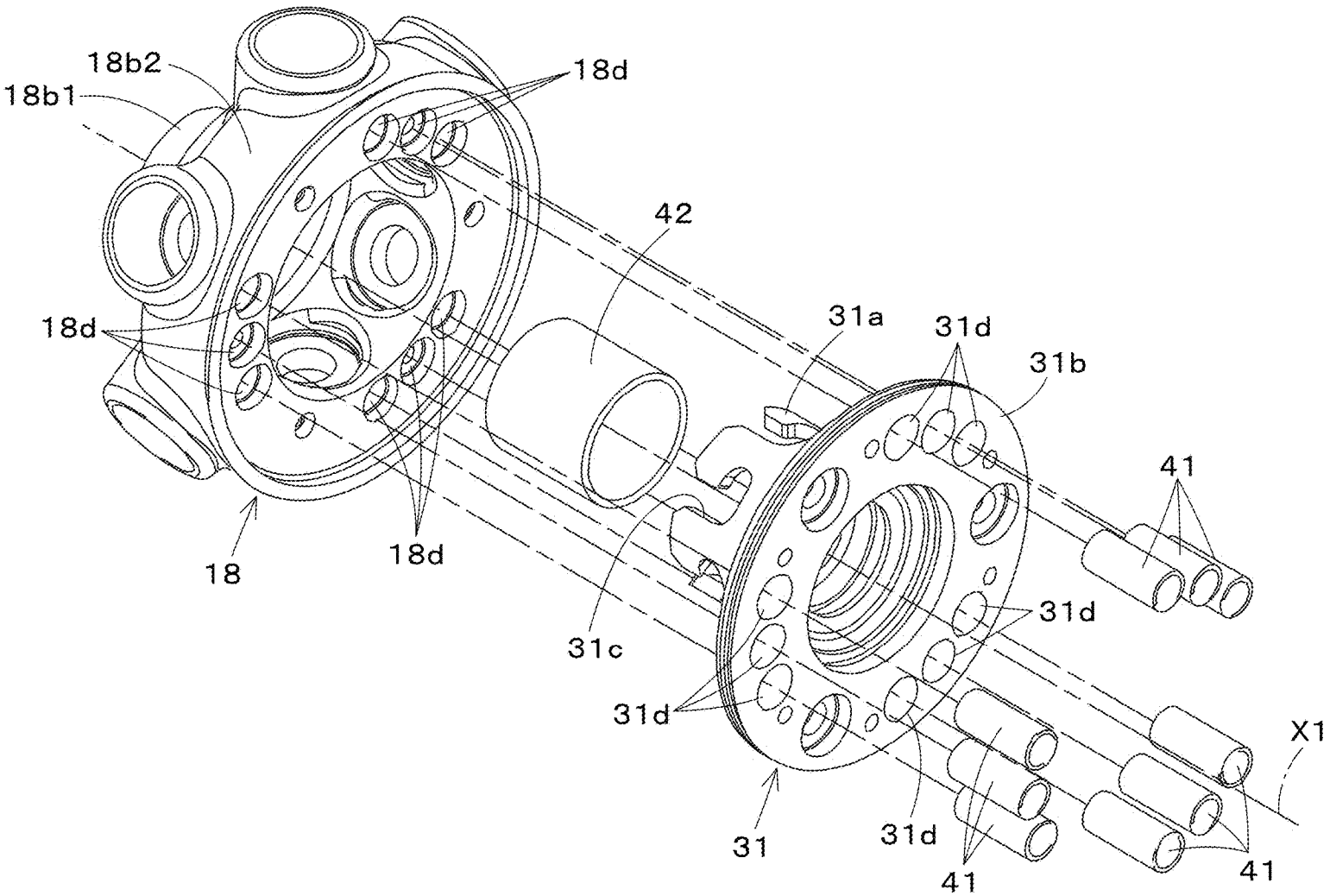
FIG. 15 is a diagram illustrating the rotator, at least one first spring, a second spring, and the movable body.

As illustrated in FIG. 15, a plurality of first springs 41 is provided. In the present example embodiment, the number of the first springs 41 is nine. However, the number of the first springs 41 is not limited to nine, and may be larger or smaller than nine. The plurality of first springs 41 is arranged in the circumferential direction around the axis X1 of the central shaft 16.

Figure 16:
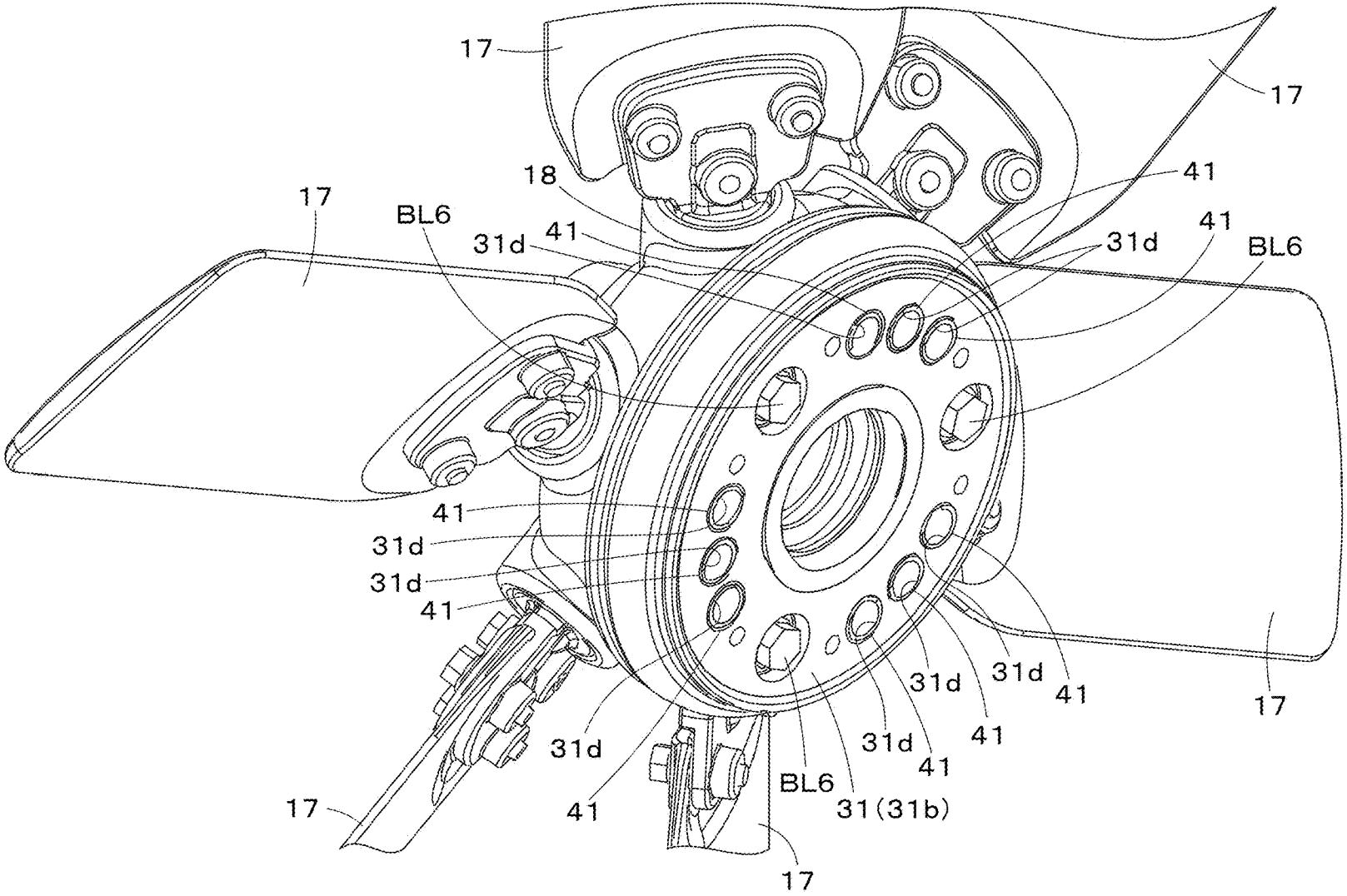
FIG. 16 is a diagram illustrating the position of the first spring relative to the movable body.

As illustrated in FIGS. 7 and 15, the plurality of first springs 41 is provided radially outward of the cylindrical portion 31*a* of the movable body 31. The first spring 41 is attached to a hole 31*d* in the flange portion 31*b* of the movable body 31 (see FIGS. 15 and 16). The hole 31*d* in the flange portion 31*b* is a through hole extending through the flange portion 31*b* in the front-rear direction. The front end of the first spring 41 protrudes from the hole 31*d* and is fitted into a recess 18*d* in the rotator 18 (see FIGS. 7 and 15). The rear end of the first spring 41 abuts against the front surface of at least one retaining plate 45 that retains the first spring 41 from the rear.

Figure 17:
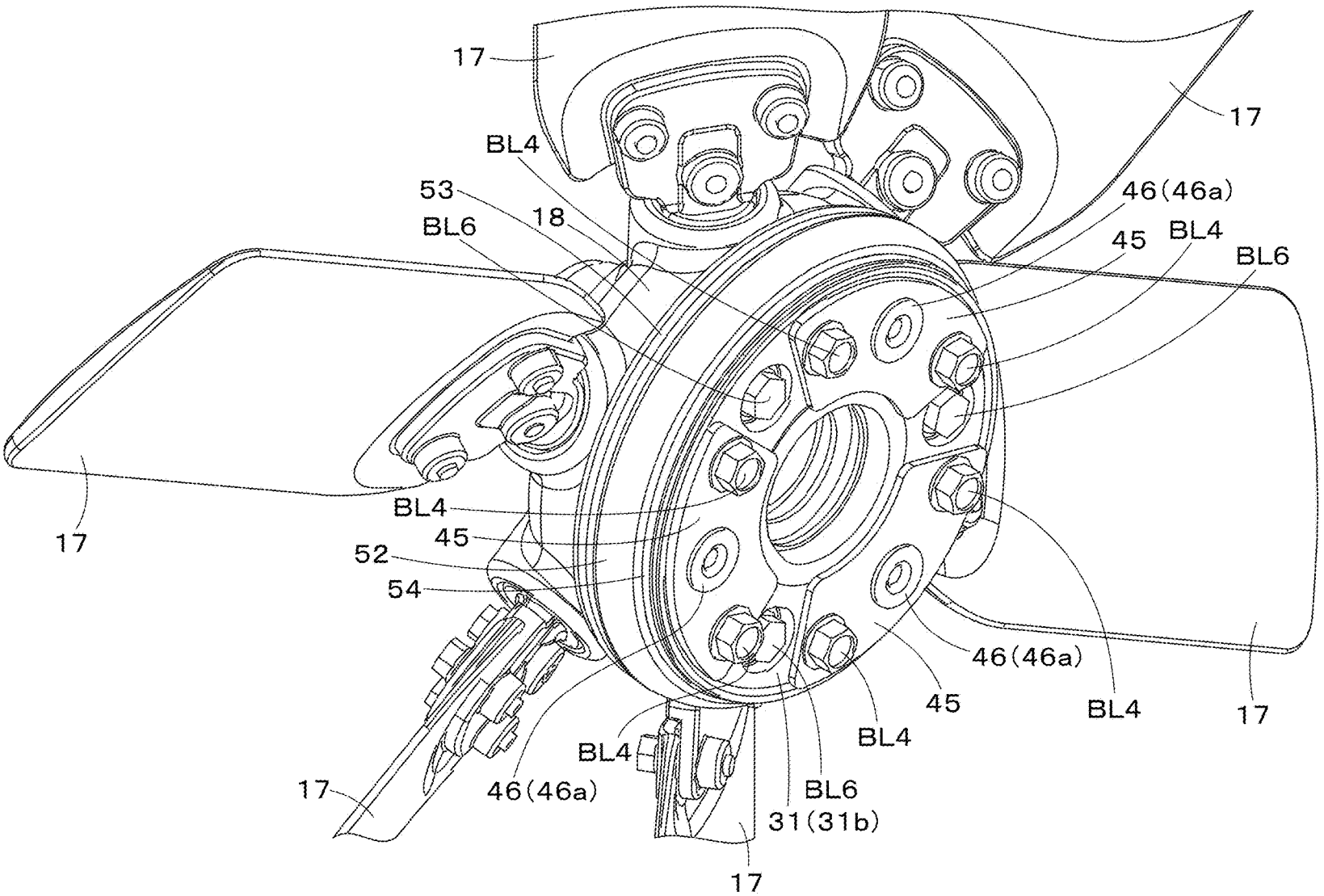
FIG. 17 is a diagram illustrating a state in which the first spring is retained by at least one retaining plate.

As illustrated in FIG. 17, the retaining plate 45 is fixed to the rear surface of the flange portion 31*b* of the movable body 31. Specifically, the screw shaft of a bolt BL4 is inserted through a through hole in the retaining plate 45, and the screw shaft of the bolt BL4 threadedly engages with a screw hole in the flange portion 31*b*. Thus, the retaining plate 45 is fixed to the rear surface of the flange portion 31*b*. In this manner, the rear end of the first spring 41 is retained by the retaining plate 45 fixed to the rear surface of the flange portion 31*b*. Thus, the first spring 41 is prevented from coming off the hole 31*d* in the flange portion 31*b*.

Fasteners 46 (see FIG. 17) are inserted into some (three) first springs 41 out of the plurality of (nine) first springs 41. The fastener 46 includes a disc-shaped flange 46*a* and a forward protrusion (not illustrated) protruding forward from the flange 46*a*. The flange 46*a* abuts against the rear surface of the retaining plate 45. The forward protrusion is inserted into the first spring 41 through the through hole in the retaining plate 45.

As described above, the front end of the first spring 41 is fitted into the recess 18*d* in the rotator 18, and the rear end of the first spring 41 abuts against the front surface of the retaining plate 45 fixed to the rear surface of the flange portion 31*b* (see FIG. 7). Thus, the first spring 41 biases the movable body 31 rearward (arrow A2 direction) relative to the rotator 18.

The retaining plate 45 can be removed by removing the bolt BL4. The first spring 41 can be removed by removing the retaining plate 45. Since the retaining plate 45 can be removed easily, the first spring 41 can be removed easily.

By removing the first spring 41, the number of the first springs 41 can be adjusted (increased or reduced) or the first spring 41 can be replaced with a spring having a different spring force (spring constant). Thus, the biasing force of the spring 40 can be adjusted. Since the spring 40 includes the first spring 41 that can be removed easily, the biasing force of the spring 40 can be adjusted more easily than in a case where the spring 40 is the second spring 42 alone.

As illustrated in FIGS. 6 and 17, a plurality of retaining plates 45 is provided. In the present example embodiment, three retaining plates 45 are provided. The plurality of retaining plates 45 can be attached or removed individually. The plurality of retaining plates 45 abuts against different first springs 41. Specifically, one of the three retaining plates 45 abuts against three out of the nine first springs 41. Another one of the three retaining plates 45 abuts against another three out of the nine first springs 41. The remaining one of the three retaining plates 45 abuts against the remaining three out of the nine first springs 41.

As described above, the plurality of retaining plates 45 that can individually be attached or removed abuts against different first springs 41. Therefore, the first springs 41 can be increased or reduced in number or can be replaced by removing only the retaining plate 45 that abuts against the first springs 41 to be increased or reduced in number or replaced among the plurality of retaining plates 45.

As illustrated in FIGS. 7, 15, and the like, the second spring 42 is provided radially inward of the cylindrical portion 31*a* of the movable body 31. Specifically, the second spring 42 is provided between the outer peripheral surface of the central shaft 16 and the inner peripheral surface of the cylindrical portion 31*a* of the movable body 31. The column 16*a* of the central shaft 16 is inserted through the second spring 42. The front end of the second spring 42 abuts against the inner surface of the rotator 18 from the rear. The rear end of the second spring 42 abuts against the inner surface of the movable body 31 from the front. Thus, the second spring 42 biases the movable body 31 rearward (arrow A2 direction) relative to the rotator 18.

As described above, the first spring 41 and the second spring 42 bias the movable body 31 rearward relative to the rotator 18. Since the two types of springs bias the movable body 31 rearward relative to the rotator 18, the biasing force acting on the movable body 31 can be increased. Since the first spring 41 and the second spring 42 are separately provided radially inward and radially outward of the cylindrical portion 31*a* of the movable body 31, the biasing forces of the springs can act on the movable body 31 with good balance.

If the second spring 42 alone biases the movable body 31, many springs (first springs 41) need to be provided radially inward of the cylindrical portion 31*a* of the movable body 31 to obtain a sufficient biasing force. Therefore, the diameter of the cylindrical portion 31*a* needs to be increased. In the present example embodiment, the biasing force of the second spring 42 can be complemented by the biasing force of the first spring 41. Therefore, there is no need to provide many springs (first springs 41) radially inward of the cylindrical portion 31*a*. Thus, the cylindrical portion 31*a* can be downsized, and the movable body 31 and the rotator 18 can be downsized (diameters can be reduced). Accordingly, the outer diameter of the rotator 18 can be reduced relative to the outer diameter of the fan 15, and the blade body 21 can be elongated without increasing the outer diameter of the fan 15. As a result, the volume of airflow generated by driving the fan 15 can be increased without upsizing the fan 15.

As illustrated in FIGS. 7, 14, and the like, a bearing 47 is attached to the inner peripheral surface of the rear of the movable body 31. The bearing 47 is a radial bearing that rotatably supports the movable body 31. The bearing 47 is held by a bearing holder 48. The column 16*a* of the central shaft 16 is inserted through the bearing holder 48. As illustrated in FIG. 6, the bearing holder 48 includes a holding portion 48*a* and a base 48*b*. The holding portion 48*a* has a cylindrical shape, and protrudes forward from the base 48*b*. The bearing 47 is supported by the outer peripheral surface of the holding portion 48*a*. The bearing 47 is interposed between the outer peripheral surface of the holding portion 48*a* and the inner peripheral surface of the movable body 31. Thus, the bearing holder 48 and the movable body 31 are connected via the bearing 47. The movable body 31 is rotatable about the axis X1 of the central shaft 16 relative to the bearing holder 48.

As illustrated in FIGS. 6 and 14, a ring 49 is provided forward of the bearing 47. The ring 49 is a C-shaped structure. The ring 49 is fitted into a groove in the outer peripheral surface of the holding portion 48*a* of the bearing holder 48. The ring 49 abuts against the front of the bearing 47. The retaining plate 45 fixed to the movable body 31 abuts against the rear of the bearing 47.

Figure 3:
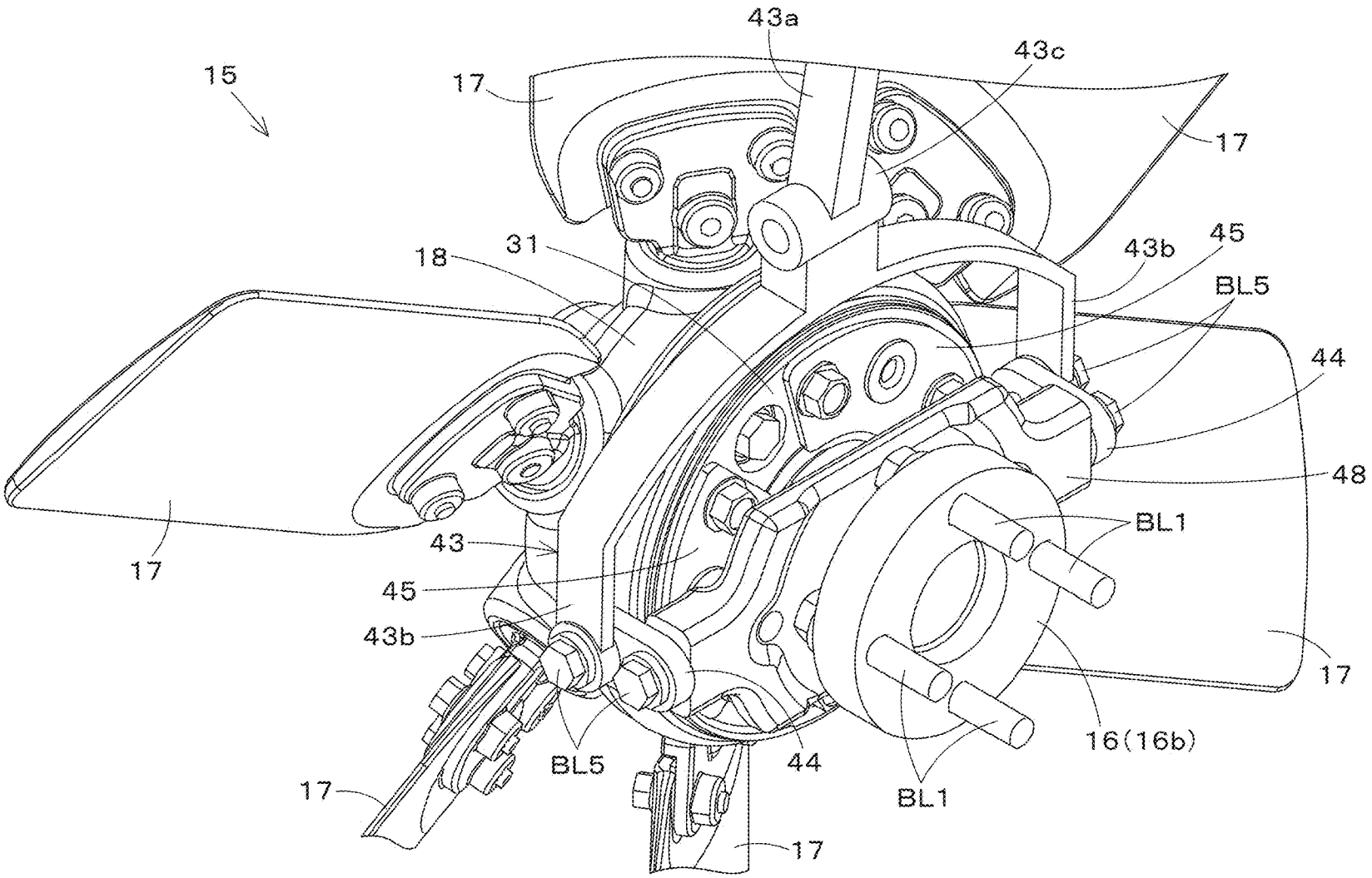
FIG. 3 is a rear perspective view of the fan.

As illustrated in FIGS. 3, 6, and the like, the actuator 43 is attached to the base 48*b* of the bearing holder 48. The actuator 43 includes a bar-shaped operation portion 43*a* and an attachment portion 43*b* bifurcated from the lower end of the operation portion 43*a*. The attachment portion 43*b* is attached to the bearing holder 48 via attachment plates 44 with bolts BL5. The left portion of the bifurcated attachment portion 43*b* is attached to the left portion of the bearing holder 48. The right portion of the bifurcated attachment portion 43*b* is attached to the right portion of the bearing holder 48.

A tube 43*c* is provided to the lower portion of the operation portion 43*a*. A support pin 50 that supports the actuator 43 is inserted through the tube 43*c* (see FIG. 4). The support pin 50 extends in the lateral direction. As illustrated in FIG. 4, one end of the wire 51 is connected to the upper portion of the operation portion 43*a*. The wire 51 extends rearward (toward the engine 8). The other end of the wire 51 is connected to a motor (not illustrated) via a gear mechanism or the like. The wire 51 is movable in the front-rear direction by driving the motor. The wire 51 may be movable in the front-rear direction by, for example, a manual lever other than the motor.

When the wire 51 moves in the front-rear direction, the operation portion 43*a* is pushed or pulled in the front-rear direction, and the attachment portion 43*b* swings in the front-rear direction about the support pin 50. When the attachment portion 43*b* swings forward, the bearing holder 48 moves forward. When the attachment portion 43*b* swings rearward, the bearing holder 48 moves rearward. That is, the actuator 43 swings in the front-rear direction along with the movement of the wire 51 in the front-rear direction, and the bearing holder 48 moves in the front-rear direction. Along with the movement of the bearing holder 48 in the front-rear direction, the movable body 31 moves in the front-rear direction.

Figure 18:
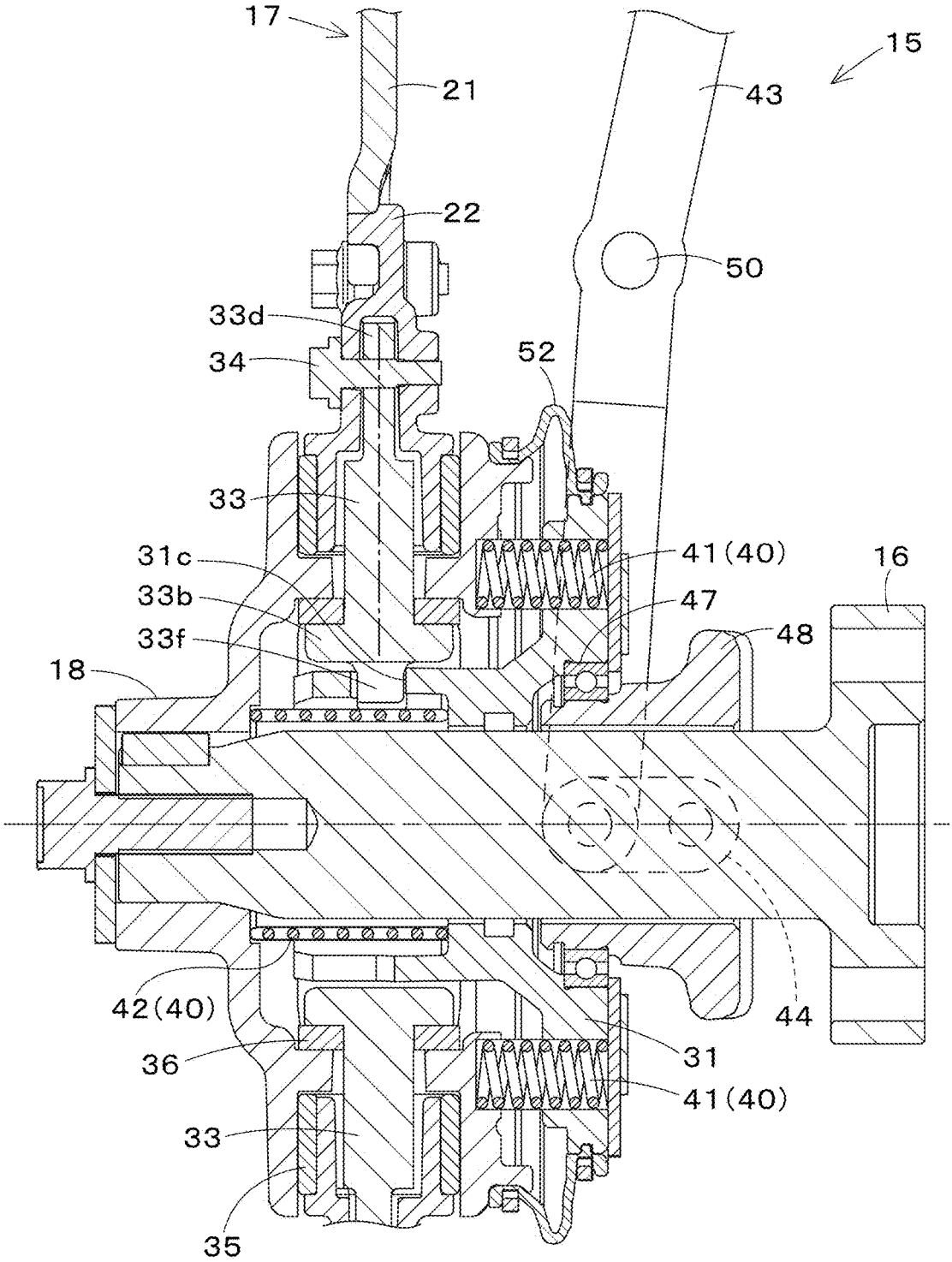
FIG. 18 is a sectional view of the fan cut in the vertical direction at the center in the lateral direction (in a state in which the rotary blade is in a neutral position).
Figure 19:
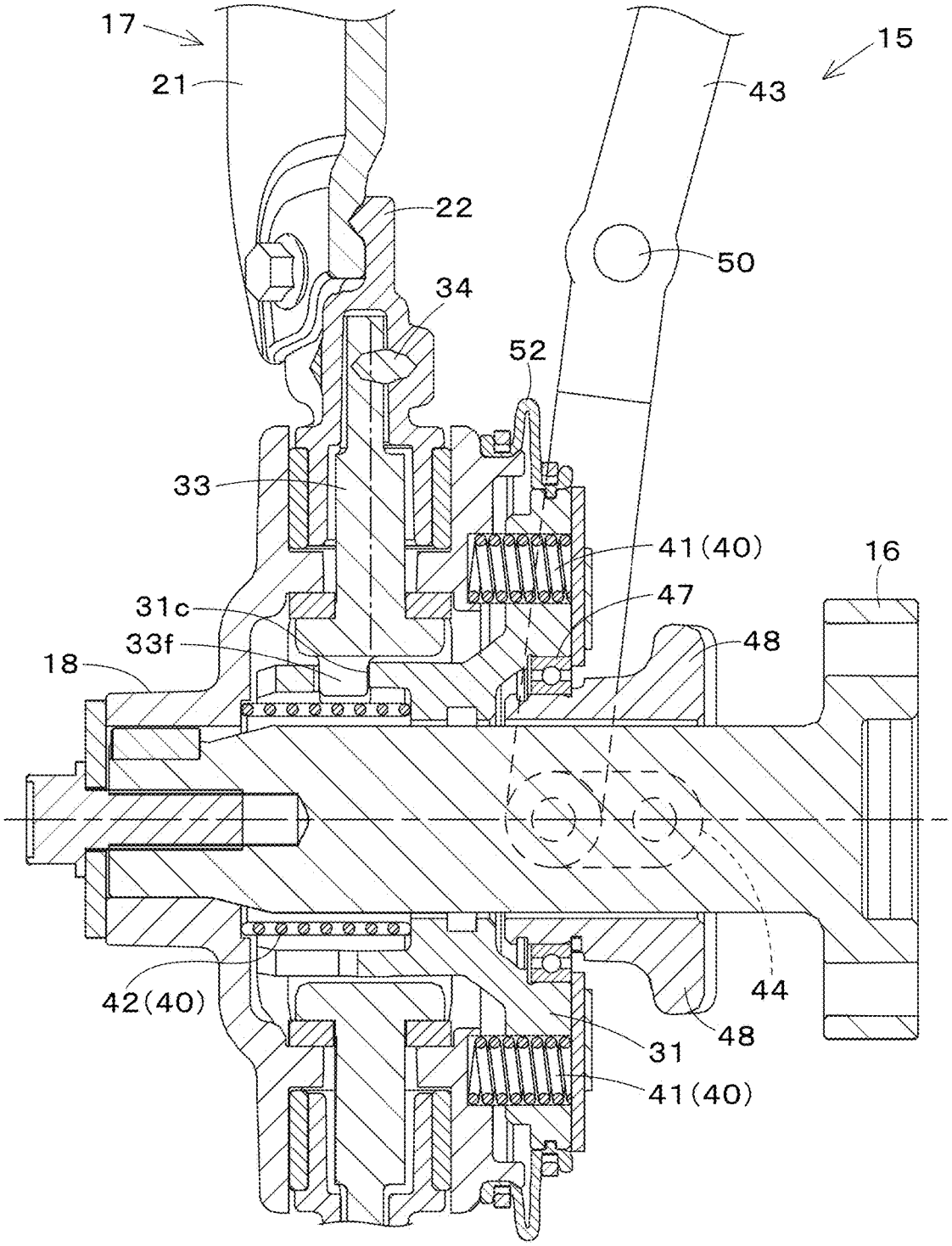
FIG. 19 is a sectional view of the fan cut in the vertical direction at the center in the lateral direction (in a state in which the rotary blade is in a normal flow position).

FIGS. 7, 18, and 19 illustrate motions of the movable body 31 and the like when the actuator 43 is operated to swing. FIG. 7 illustrates a state in which the actuator 43 swings forward (first state). FIG. 18 illustrates a state in which the actuator 43 is in a neutral position (second state). FIG. 19 illustrates a state in which the actuator 43 swings rearward (third state).

In the first state illustrated in FIG. 7, the fore-and-aft position of the movable body 31 relative to the rotator 18 is the rearmost position (first position). When the actuator 43 in the first state swings rearward against the biasing force of the spring 40, the spring 40 is compressed, the bearing holder 48, the bearing 47, the movable body 31, and the retaining plate 45 move forward, and the state becomes the second state illustrated in FIG. 18. In the second state, the fore-and-aft position of the movable body 31 relative to the rotator 18 is a second position forward of the first position.

When the actuator 43 in the second state illustrated in FIG. 18 further swings rearward, the spring 40 is further compressed, the bearing holder 48, the bearing 47, the movable body 31, and the retaining plate 45 further move forward, and the state becomes the third state illustrated in FIG. 19. In the third state, the fore-and-aft position of the movable body 31 relative to the rotator 18 is the foremost position (third position).

When the actuator 43 in the third state illustrated in FIG. 19 swings forward, the bearing holder 48, the bearing 47, the movable body 31, and the retaining plate 45 move rearward by the biasing force of the spring 40 (extending force), and the state becomes the second state illustrated in FIG. 18.

When the actuator 43 in the second state illustrated in FIG. 18 further swings forward, the bearing holder 48, the bearing 47, the movable body 31, and the retaining plate 45 further move rearward by the biasing force of the spring 40 (extending force), and the state becomes the first state illustrated in FIG. 7.

As described above, the movable body 31 moves in the front-rear direction relative to the rotator 18 by swinging the actuator 43 in the front-rear direction. Specifically, the movable body 31 move forward relative to the rotator 18 by swinging the actuator 43 rearward, and the movable body 31 moves rearward relative to the rotator 18 by swinging the actuator 43 forward.

Figure 13:
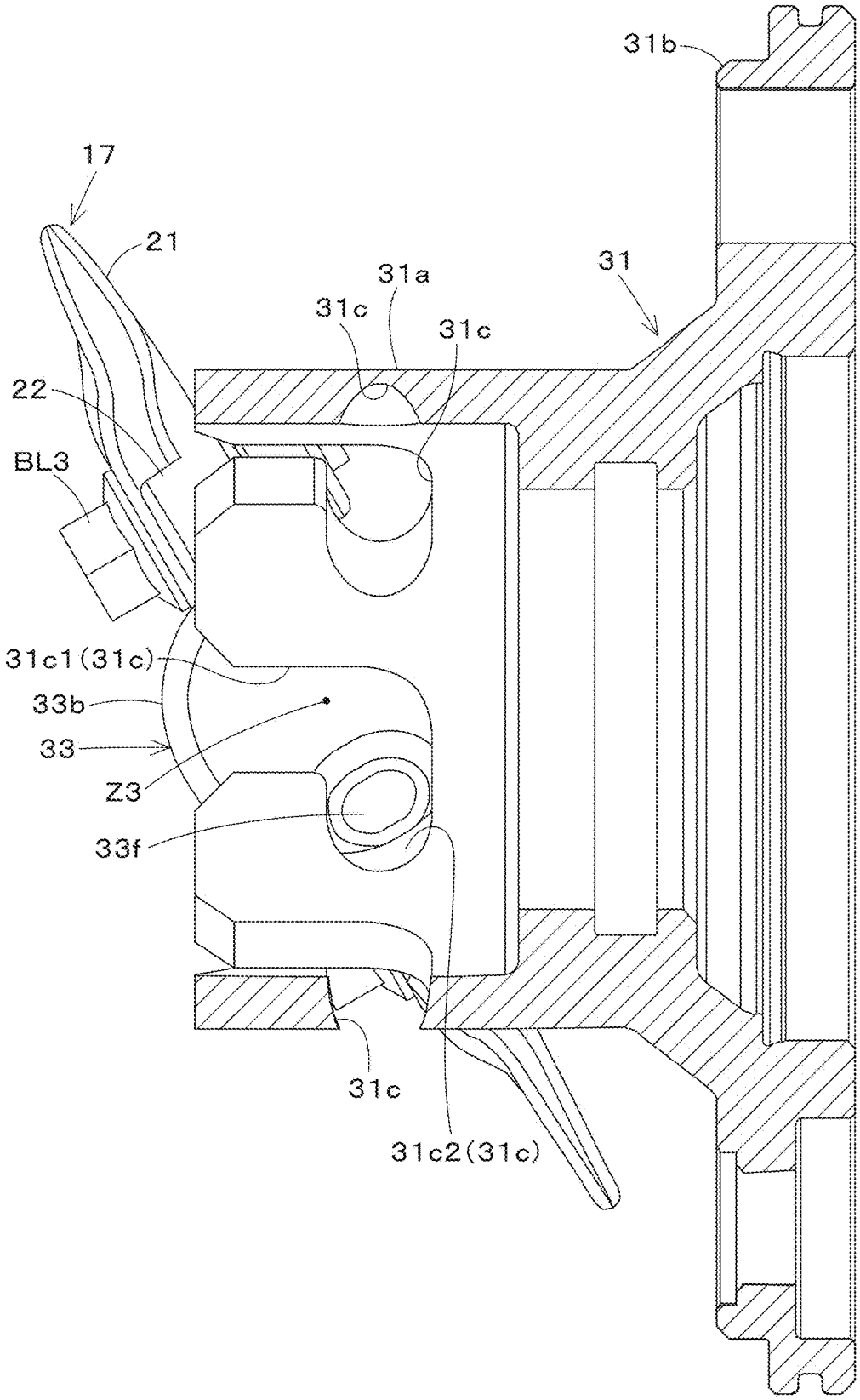
FIG. 13 is a sectional view of the movable body in the state in which the protrusion is inserted into one engagement groove when viewed from the central shaft.

Next, the following description discusses motions of the insert 33 along with the movement of the movable body 31 described above. First, the following description discusses the relationship between the protrusion 33*f* of the insert 33 and the engagement groove 31*c* in the movable body 31. As illustrated in FIGS. 12 and 13, the protrusion 33*f* provided to the insert 33 is inserted into the second groove portion 31*c*2 of the engagement groove 31*c* in the movable body 31.

The protrusion 33*f* is not inserted into the second groove portion 31*c*2 by the movement of the movable body 31 in the front-rear direction based on the operation of the actuator 43 described above, but is inserted into the second groove portion 31*c*2 when the movable body 31 is attached to the rotator 18.

When the movable body 31 is attached to the rotator 18, the movable body 31 is moved forward (arrow A1 direction in FIG. 20), and the protrusion 33*f* is inserted into the first groove portion 31*c*1 of the engagement groove 31*c*. At this time, the protrusion 33*f* is inserted to the rearmost portion of the first groove portion 31*c*1, and then the movable body 31 is rotated counterclockwise (arrow Cl direction in FIG. 20) in a rear view. Thus, the protrusion 33*f* moves from the first groove portion 31*c*1 to the second groove portion 31*c*2, and enters the deepest portion of the second groove portion 31*c*2. In the state in which the protrusion 33*f* is in the second groove portion 31*c*2, the flange portion 31*b* of the movable body 31 and the rotator 18 are fixed with a bolt BL6.

As described above, the protrusion 33*f* is inserted into the second groove portion 31*c*2 when the movable body 31 is attached to the rotator 18. Since the protrusion 33*f* is inserted into the second groove portion 31*c*2, the position of the protrusion 33*f* in the front-rear direction relative to the movable body 31 is regulated. Therefore, the protrusion 33*f* cannot move in the front-rear direction relative to the movable body 31. However, the rotation of the protrusion 33*f* is not regulated by the second groove portion 31*c*2. Therefore, the protrusion 33*f* can rotate in the second groove portion 31*c*2. Specifically, the protrusion 33*f* can rotate in the second groove portion 31*c*2 together with the insert 33 about an axis corresponding to the axis Z3 of the insert 33 (see FIGS. 12, 13, and 7).

Figure 21:
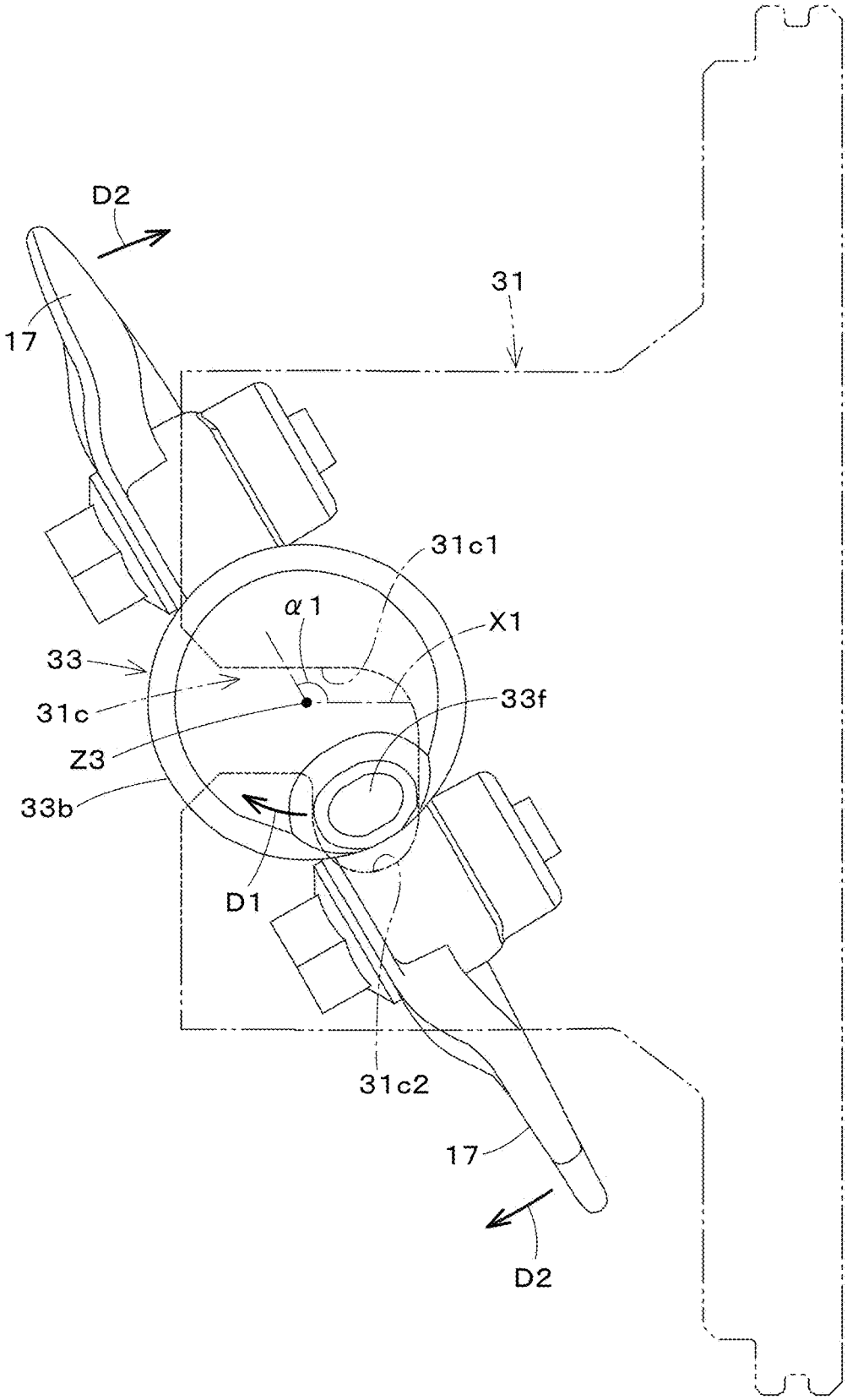
FIG. 21 is a diagram of the insert viewed from the central shaft (protrusion) when the movable body is in a first position.
Figure 22:
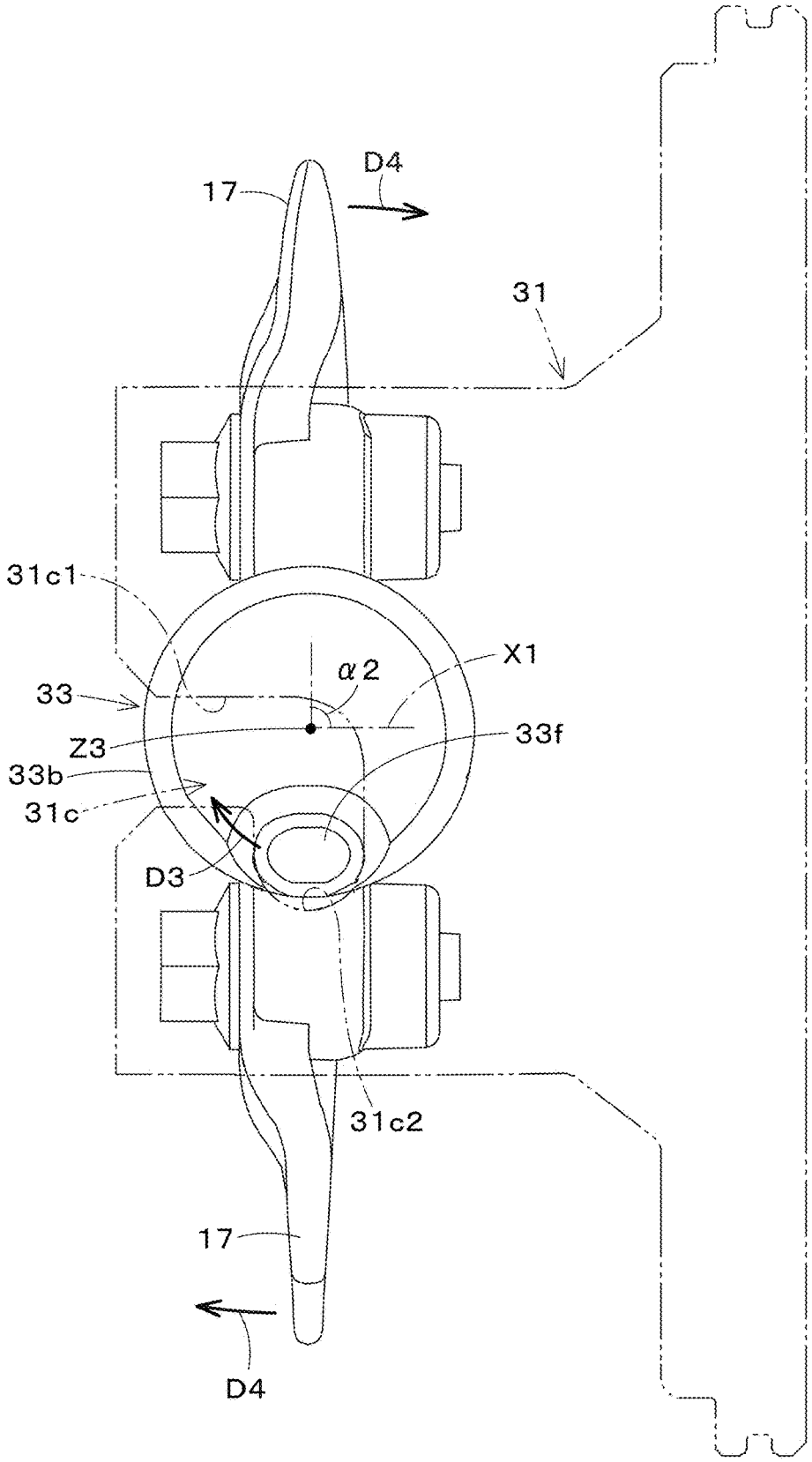
FIG. 22 is a diagram of the insert viewed from the central shaft (protrusion) when the movable body is in a second position.
Figure 23:
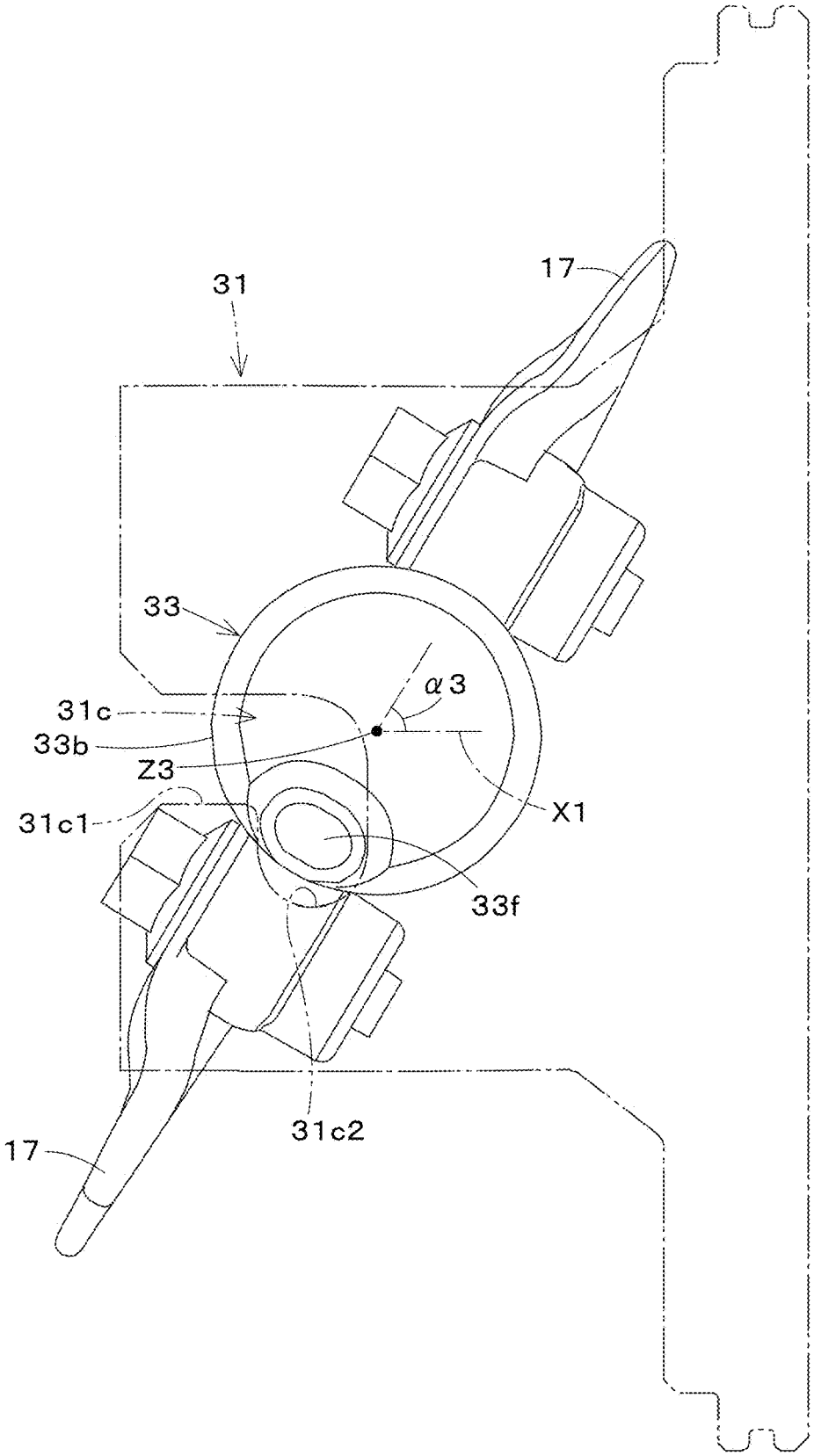
FIG. 23 is a diagram of the insert viewed from the central shaft (protrusion) when the movable body is in a third position.

Next, description is made about motions of the insert 33 along with the movement of the movable body 31. FIGS. 21 to 23 are diagrams of the insert 33 viewed from the central shaft 16 (protrusion 33*f*). FIG. 21 is a diagram when the movable body 31 is in the first position illustrated in FIG. 7. FIG. 22 is a diagram when the movable body 31 is in the second position illustrated in FIG. 18. FIG. 23 is a diagram when the movable body 31 is in the third position illustrated in FIG. 19.

When the movable body 31 moves from the first position illustrated in FIG. 7 to the second position illustrated in FIG. 18, the protrusion 33*f* inserted into the second groove portion 31*c*2 of the movable body 31 is pushed forward along with the movement of the movable body 31. As described above, however, the protrusion 33*f* cannot move in the front-rear direction relative to the movable body 31. Therefore, the protrusion 33*f* rotates together with the insert 33 about the axis corresponding to the axis Z3 of the insert 33 by being pushed forward (see an arrow D1). Along with the rotation of the insert 33, the rotary blade 17 (and the fastening 34) rotates about the axis corresponding to the axis Z3 of the insert 33 (see an arrow D2). Thus, the angle of the rotary blade 17 relative to the central shaft 16 changes from an angle $\alpha$1 (first angle) illustrated in FIG. 21 to an angle $\alpha$2 (second angle) illustrated in FIG. 22.

When the movable body 31 subsequently moves from the second position illustrated in FIG. 18 to the third position illustrated in FIG. 19, the protrusion 33*f* inserted into the second groove portion 31*c*2 of the movable body 31 is further pushed forward along with the movement of the movable body 31. As described above, however, the protrusion 33*f* cannot move in the front-rear direction relative to the movable body 31. Therefore, the protrusion 33*f* rotates together with the insert 33 about the axis corresponding to the axis Z3 of the insert 33 by being pushed forward (see an arrow D3). Along with the rotation of the insert 33, the rotary blade 17 and the fastening 34 rotate about the axis corresponding to the axis Z3 of the insert 33 (see an arrow D4). Thus, the angle of the rotary blade 17 relative to the central shaft 16 (angle relative to the axis X1) changes from the angle $\alpha$2 (second angle) illustrated in FIG. 22 to an angle $\alpha$3 (third angle) illustrated in FIG. 23.

When the movable body 31 moves conversely from the third position illustrated in FIG. 19 to the second position illustrated in FIG. 18, the angle of the rotary blade 17 relative to the central shaft 16 changes from the angle $\alpha$3 (third angle) illustrated in FIG. 23 to the angle $\alpha$2 (second angle) illustrated in FIG. 22. At this time, the rotation direction of the protrusion 33*f* and the insert 33 is opposite to the rotation direction when the movable body 31 moves from the second position to the third position. When the movable body 31 moves from the second position illustrated in FIG. 18 to the first position illustrated in FIG. 7, the angle of the rotary blade 17 relative to the central shaft 16 changes from the angle $\alpha$2 (second angle) illustrated in FIG. 22 to the angle $\alpha$1 (first angle) illustrated in FIG. 21. At this time, the rotation direction of the protrusion 33*f* and the insert 33 is opposite to the rotation direction when the movable body 31 moves from the first position to the second position.

As described above, the protrusion 33*f* rotates in the engagement groove 31*c* (second groove portion 31*c*2) along with the movement of the movable body 31. The protrusion 33*f* rotates in one direction in the second groove portion 31*c*2 when the movable body 31 moves in the first direction (forward), and rotates in the other direction (opposite to the one direction) in the second groove portion 31*c*2 when the movable body 31 moves in the second direction (rearward).

The insert 33 rotates together with the rotary blade 17 about the axis corresponding to the axis Z3 of the insert 33 (radial axis) along with the rotation of the protrusion 33*f*. Then, the rotary blade 17 turns about the axis corresponding to the axis Z3 of the insert 33 (radial axis) to change the angle of the rotary blade 17 relative to the central shaft 16.

As illustrated in FIG. 22, when the movable body 31 is in the second position, the major axis of the ellipse of the protrusion 33*f* having the elliptical column shape is oriented in the front-rear direction. Therefore, irrespective of whether the protrusion 33*f* is pushed forward or rearward by the movement of the movable body 31, the pushing force acting on the protrusion 33*f* can be received by an outer surface on the major axis of the ellipse. Thus, the protrusion 33*f* can be prevented from being deformed or damaged when the pushing force is received.

Since the protrusion 33*f* has the elliptical column shape, a clearance is secured between the outer surface of the protrusion 33*f* and the inner surface of the second groove portion 31*c*2 when the protrusion 33*f* rotates in the second groove portion 31*c*2. Therefore, the protrusion 33*f* can easily rotate in the second groove portion 31*c*2. Thus, the insert 33 can rotate smoothly.

Figure 24:
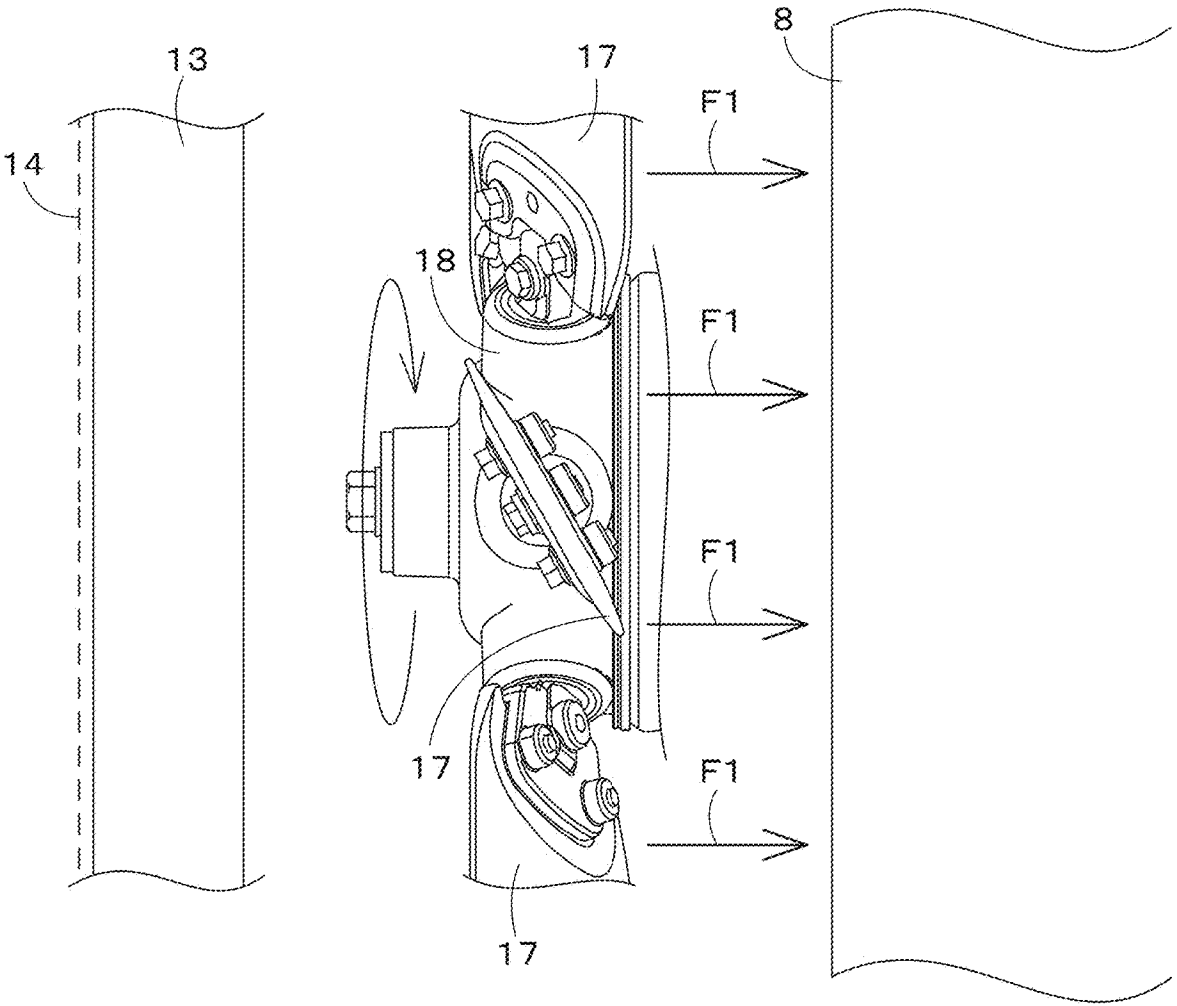
FIG. 24 is a top view of the fan when the rotary blade has a third angle (normal flow position).

FIG. 24 is a top view of the fan 15 when the rotary blade 17 has the third angle. The position of the rotary blade 17 at this time is referred to as "normal flow position." When the fan 15 rotates with the rotary blade 17 having the third angle (normal flow position), the fan 15 generates an airflow (normal airflow) F1 to cool the apparatuses (engine 8, radiator 13) mounted inside the machine body 2. With the normal airflow F1, air outside the hood 12 is introduced into the hood 12 through the dustproof cover 14 to cool the radiator 13 and the engine 8.

Figure 25:
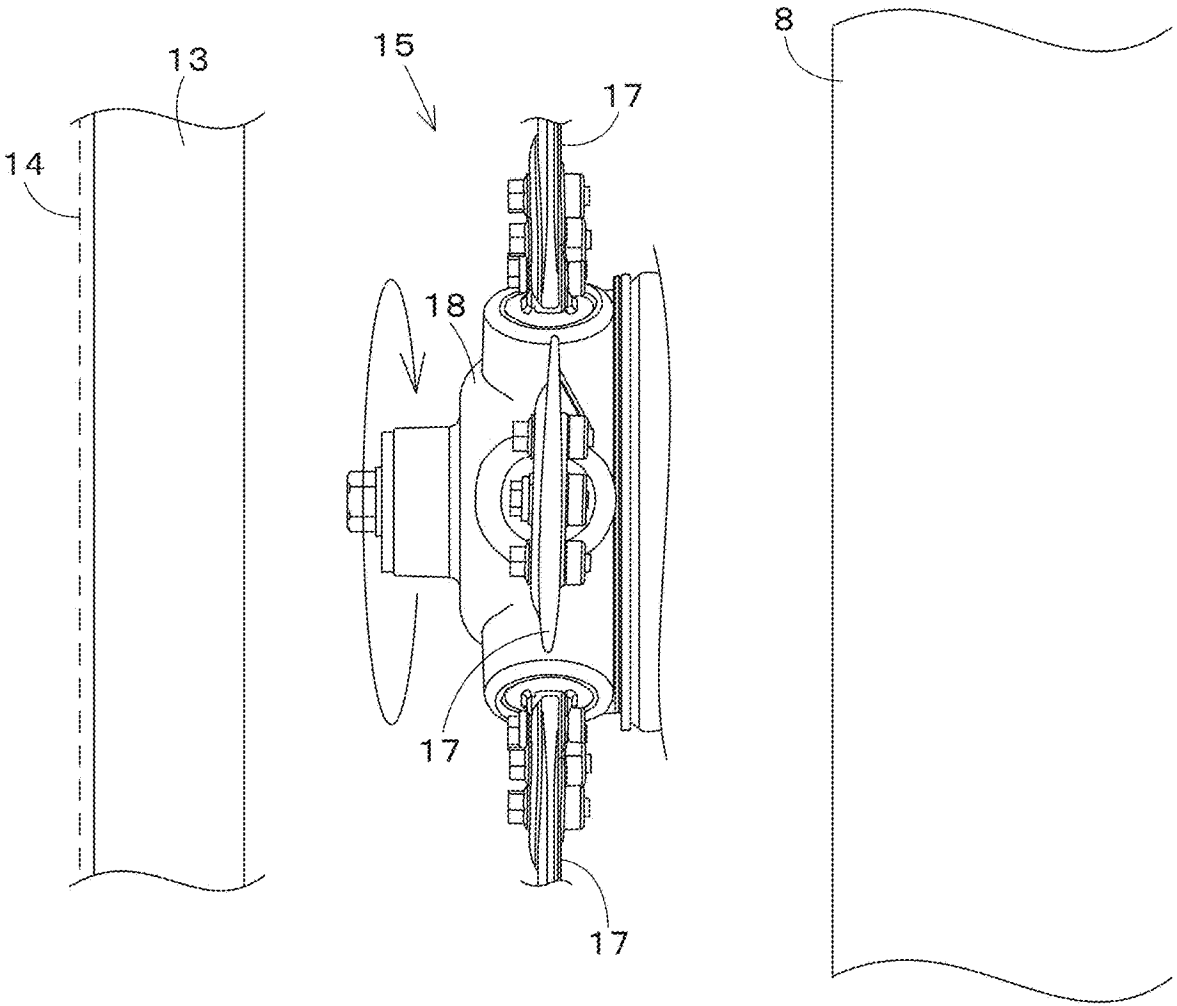
FIG. 25 is a top view of the fan when the rotary blade has a second angle (neutral position).

FIG. 25 is a top view of the fan 15 when the rotary blade 17 has the second angle. The position of the rotary blade 17 at this time is referred to as "neutral position." When the fan 15 rotates with the rotary blade 17 having the second angle (neutral position), the fan 15 generates no airflow. Therefore, the power required to rotate the fan 15 can be reduced. Thus, when a high load is applied to the engine 8 during work or travel, the load applied to the engine 8 can be reduced by the rotary blade 17 having the second angle. When the cooling of the engine 8 is unnecessary, the fuel consumption can be reduced by the rotary blade 17 having the second angle.

Figure 26:
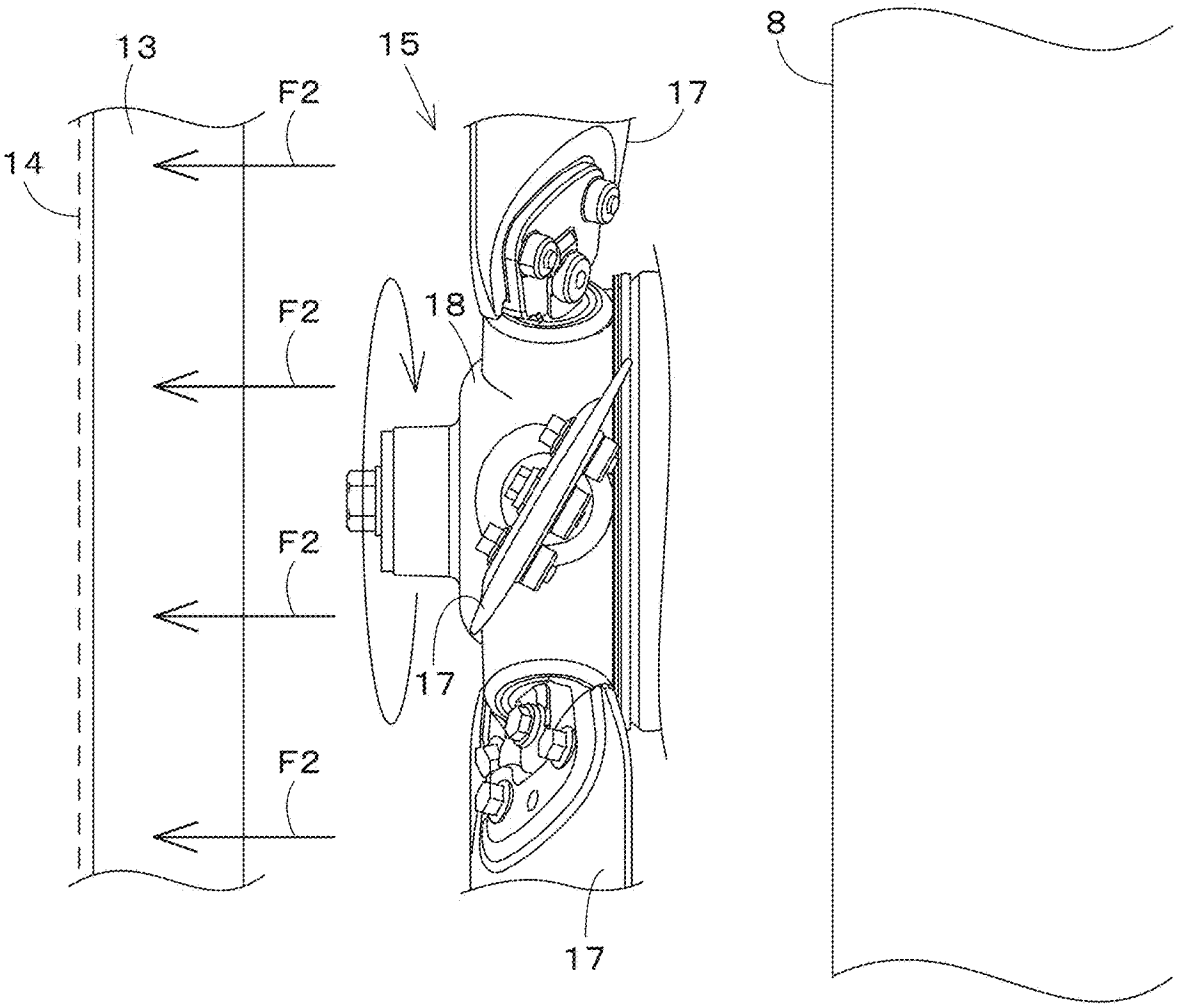
FIG. 26 is a top view of the fan when the rotary blade has a first angle (reverse flow position).

FIG. 26 is a top view of the fan 15 when the rotary blade 17 has the first angle. The position of the rotary blade 17 at this time is referred to as "reverse flow position." When the fan 15 rotates with the rotary blade 17 having the first angle (reverse flow position), the fan 15 generates an airflow (reverse airflow) F2 in a direction opposite to that of the normal airflow. With the reverse airflow F2, air inside the hood 12 is discharged out of the hood 12 through the dustproof cover 14. Thus, dust that clogs the mesh of the dustproof cover 14 can be removed by blowing the dust away.

Irrespective of whether the rotary blade 17 has the first angle, the second angle, or the third angle, the rotation direction of the central shaft 16 is the same. That is, by changing the angle of the rotary blade 17, the fan 15 can change the direction of the generated airflow without changing the rotation direction of the central shaft 16. Therefore, there is no need to provide a hydraulic motor for changing the rotation direction of the central shaft 16 and a hydraulic circuit for controlling switching of a switching valve that switches the rotation direction of the hydraulic motor.

As illustrated in FIGS. 6, 14, and 17, the fan 15 includes a connector 52 that connects the outer peripheral surface of the rotator 18 and the outer peripheral surface of the movable body 31. The connector 52 is made of an elastic body that is elastically deformable, such as rubber or soft resin. The connector 52 has a cylindrical shape, and includes a front portion 52*a* fixed to the outer peripheral surface of the rotator 18 and a rear portion 52*b* fixed to the outer peripheral surface of the movable body 31 (see FIG. 14).

The inner peripheral surface of the front portion 52*a* is fitted into a first recessed groove 18*e* in the outer peripheral surface of the rotator 18. The inner peripheral surface of the rear portion 52*b* is fitted into a second recessed groove 31*e* in the outer peripheral surface of the movable body 31. A front groove 52*c* is in the outer peripheral surface of the front portion 52*a*. A C-shaped first ring 53 is fitted into the front groove 52*c*. By fitting the first ring 53 into the front groove 52*c*, the inner peripheral surface of the front portion 52*a* is fixed to the first recessed groove 18*e*.

A rear groove 52*d* is in the outer peripheral surface of the rear portion 52*b*. A C-shaped second ring 54 is fitted into the rear groove 52*d*. By fitting the second ring 54 into the rear groove 52*d*, the inner peripheral surface of the rear portion 52*b* is fixed to the second recessed groove 31*e*.

The connector 52 covers the outer periphery of a space SP (see FIG. 7) defined between the rotator 18 and the movable body 31 in the front-rear direction. As illustrated in FIGS. 7, 18, and 19, the connector 52 extends or contracts in the front-rear direction by being elastically deformed when the movable body 31 moves between the first position illustrated in FIG. 7 and the third position illustrated in FIG. 19. Thus, when the movable body 31 moves, the space SP between the rotator 18 and the movable body 31 in the front-rear direction is not exposed to the outside. Therefore, entry of foreign matter such as dust into the space SP between the rotator 18 and the movable body 31 can be prevented.

Example embodiments of the present invention provide working machines 1 described in the following items.

(Item 1) A working machine 1 including a fan 15 to generate a first airflow to cool one or more apparatuses in a machine body 2, and a second airflow in a direction different from a direction of the first airflow, wherein the fan 15 includes a central shaft 16 to rotate about an axis X1, rotary blades 17 each extending in a radial direction of the central shaft 16, and an angle change mechanism to change an angle of each of the rotary blades 17 relative to the central shaft 16 by turning the rotary blade 17 about an axis Z2 extending in the radial direction, the angle change mechanism includes a movable body 31 that is movable in an axial direction of the central shaft 16, and a conversion mechanism to convert movement of the movable body 31 into turning movement of the rotary blades 17, and the conversion mechanism includes inserts 33 each inserted in the corresponding rotary blade 17 in the corresponding radial direction, fastenings 34 to each fix the corresponding rotary blade 17 and the corresponding insert 33 to each other, and a turning mechanism to turn each of the inserts 33 about the corresponding axis Z2 extending in the corresponding radial direction as the movable body 31 moves.

With the working machine 1 according to item 1, the direction of the airflow generated by the fan 15 can be changed by changing the angle of each of the rotary blades 17 without having to change the rotation direction of the fan 15. Therefore, there is no need for a hydraulic motor and a hydraulic circuit to change the rotation direction of the fan 15. Since each of the inserts 33 to change the angle of the corresponding rotary blade 17 is inserted in the corresponding rotary blade 17 in the radial direction of the central shaft 16, it is possible to eliminate or reduce the likelihood that stress will concentrate on the proximal end of the rotary blade 17 when the angle of the rotary blade 17 is changed.

This makes it possible to eliminate or reduce the likelihood that the driver of the fan 15 will become complicated and the fan 15 will be damaged, in the working machine 1 including the fan 15 configured to change the direction of the airflow generated by rotation thereof.

Since each of the inserts 33 to change the angle of the corresponding rotary blade 17 is inserted in the rotary blade 17 in the radial direction of the central shaft 16, it is possible to achieve a small sized connection structure between the rotary blade 17 and the insert 33. In particular, it is possible to achieve a small sized connection structure in the length direction of the rotary blade 17 (radial direction of the central shaft 16). This makes it possible to increase the length of each of the rotary blades 17 relative to the outer diameter of the fan 15. With this, it is possible to achieve a sufficient airflow volume while preventing or reducing an increase in the size of the fan 15. Further, the connection between the rotary blade 17 and the insert 33 can be achieved using a small number of components. Therefore, the fan 15 can be reduced in size and the manufacturing cost can be reduced. Since the connection strength between the rotary blade 17 and the insert 33 is high, a decrease in the connection strength due to the drive of the fan 15 can be prevented or reduced.

(Item 2) The working machine according to item 1, wherein each of the rotary blades 17 includes a blade body 21, and a holder 22 to hold a portion of the blade body 21 that is adjacent to the central shaft 16, and each of the fastenings 34 is configured to fix the corresponding holder 22 and the corresponding insert 33 to each other.

With the working machine 1 according to item 2, each of the rotary blades 17 and the corresponding insert 33 can be connected firmly and reliably by fixing the corresponding holder 22 and the corresponding insert 33 to each other using the corresponding fastening 34. Therefore, the connection strength between the rotary blade 17 and the insert 33 can be improved, making it possible to reliably prevent or reduce a decrease in the connection strength due to the drive of the fan 15.

(Item 3) The working machine 1 according to item 1 or 2, wherein each of the fastenings 34 extends in a direction parallel or substantially parallel to the central shaft 16.

With the working machine 1 according to item 3, since each of the fastenings 34 extends in the direction parallel or substantially parallel to the central shaft 16, the fixing achieved by the fastening 34 is less likely to loosen due to the drive of the fan 15 than when the fastening 34 extends in the radial direction of the central shaft 16. For example, if a nut is screwed on a bolt (fastening) extending in the radial direction of the central shaft 16, the nut may loosen due to the drive of the fan 15 (rotation of the central shaft 16). With the fastening 34 extending in the direction parallel or substantially parallel to the central shaft 16, such an instance can be prevented or reduced.

(Item 4) The working machine 1 according to item 2 or 3, further including a rotator 18 to rotate together with the central shaft 16 and the rotary blades 17, the rotator 18 including a tubular portion 18*b* provided around the central shaft 16 and insertion openings 18*c* in the tubular portion 18*b* to receive the respective holders 22, wherein the movable body 31 is movable relative to the rotator 18.

The working machine 1 according to item 4 includes a structure in which the angle of each of the rotary blades 17 is changed by moving the movable body 31 relative to the rotator 18. Therefore, the power required to change the angle of the rotary blades 17 can be reduced compared to a structure in which the angle of the rotary blades 17 is changed by moving both the rotator 18 and the movable body 31.

(Item 5) The working machine 1 according to any one of items 1 to 4, wherein the turning mechanism includes protrusions 33*f* included in the respective inserts 33 and protruding toward the central shaft 16, and engagement grooves 31*c* provided in the movable body 31 to engage with the protrusions 33*f*, each of the protrusions 33*f* is offset from an axis of the corresponding insert 33 and is rotatable in the corresponding engagement groove 31*c* as the movable body 31 moves, and each of the inserts 33 is turnable together with the corresponding rotary blade 17 about the corresponding axis Z2 extending in the corresponding radial direction as the corresponding protrusion 33*f* rotates.

With the working machine 1 according to item 5, the angle of the rotary blades 17 can be changed by rotating, in the respective engagement grooves 31*c*, the protrusions 33*f* of the inserts 33. Thus, the angle of the rotary blades 17 can be changed without having to use a complex mechanism such as a gear mechanism, making it possible to achieve a small sized fan 15.

(Item 6) The working machine 1 according to item 5 taken in combination with item 2, wherein each of the inserts 33 includes a shaft portion 33*a* inserted in the corresponding holder 22, and a head portion 33*b* provided at an end of the shaft portion 33*a* that is adjacent to the central shaft 16 and located outside the corresponding holder 22, and each of the protrusions 33*f* is integral with the corresponding head portion 33*b*.

With the working machine 1 according to item 6, the protrusions 33*f* are integral with the respective head portions 33*b* of the inserts 33. Thus, there is no need to connect another structure (bolt, pin, or the like) to define the protrusion 33*f* on each of the inserts 33. Therefore, it is possible to eliminate or reduce the likelihood that the protrusion 33*f* connected to the insert 33 will loosen or come off as the action to change the angle of the rotary blade 17 is repeated.

(Item 7) The working machine 1 according to item 5, wherein each of the protrusions 33*f* has a shape of an elliptical column.

With the working machine 1 according to item 7, since the pushing force acting on each of the protrusions 33*f* is received by the outer surface at an end of the major axis of the ellipse, it is possible to eliminate or reduce the likelihood that the protrusion 33*f* will deform or be damaged upon receipt of the pushing force. Further, since a clearance is present between the outer surface of the protrusion 33*f* and the inner surface of the second groove portion 31*c*2 when the protrusion 33*f* rotates in the second groove portion 31*c*2, the protrusion 33*f* can easily rotate in the second groove portion 31*c*2. Thus, the inserts 33 can be turned smoothly.

(Item 8) The working machine 1 according to item 6, wherein each of the fastenings 34 is configured to fix the corresponding shaft portion 33*a* and the corresponding holder 22 to each other.

With the working machine 1 according to item 8, since each of the fastenings 34 fixes the corresponding shaft portion 33*a* and the corresponding holder 22 to each other, the corresponding insert 33 and the corresponding rotary blade 17 can be connected via the holder 22. By fixing the shaft portion 33*a* and the holder 22 to each other, the insert 33 and the holder 22 can be connected reliably by the fastening 34. Therefore, the connection strength between the insert 33 and the holder 22 can be improved.

(Item 9) The working machine 1 according to item 8, wherein each of the shaft portions 33*a* includes a first through hole 33*e*, each of the holders 22 includes a second through hole 22*e*, and each of the fastenings 34 is a bolt passing through the corresponding first through hole 33*e* and the corresponding second through hole 22*e*.

With the working machine 1 according to item 9, each of the inserts 33 and the corresponding holder 22 can be connected reliably by the corresponding fastening 34 with high strength using a simple structure.

(Item 10) The working machine 1 according to any one of items 5 to 7, wherein the movable body 31 includes a cylindrical portion 31*a* provided around the central shaft 16, and the engagement grooves 31*c* are provided in the cylindrical portion 31*a*.

With the working machine 1 according to item 10, since the engagement grooves 31*c* are provided around the central shaft 16, the engagement grooves 31*c* that are provided around the central shaft 16 to receive the protrusions 33*f* of the plurality of inserts 33 can be provided in the movable body 31.

(Item 11) The working machine 1 according to item 10, wherein each of the engagement grooves 31*c* includes a first groove portion 31*c*1 extending in a direction parallel or substantially parallel to the central shaft 16, and a second groove portion 31*c*2 continuous with the first groove portion 31*c*1 and extending in a circumferential direction of the cylindrical portion 31*a*, the movable body 31 is movable in a first direction A1 along the axial direction, and in a second direction A2 that is another direction along the axial direction, and each of the protrusions 33*f* is rotatable in one direction in the second groove portion 31*c*2 when the movable body 31 moves in the first direction, and rotatable in another direction in the second groove portion 31*c*2 when the movable body 31 moves in the second direction.

With the working machine 1 according to item 11, when the movable body 31 moves in the front-rear direction, each of the protrusions 33*f* rotates in the corresponding second groove portion 31*c*2 without moving in the front-rear direction, making it possible to eliminate or reduce the likelihood that the protrusion 33*f* will come off the engagement groove 31*c*. Furthermore, when the movable body 31 is to be attached to the rotator 18, each of the protrusions 33*f* can be guided to the second groove portion 31*c*2 after being inserted into the first groove portion 31*c*1. Therefore, the protrusion 33*f* can be easily and reliably inserted into the second groove portion 31*c*2.

(Item 12) The working machine 1 according to item 10 or 11, wherein the movable body 31 is movable in a first direction along the axial direction, and in a second direction that is another direction along the axial direction, the angle change mechanism includes at least one spring 40 to bias the movable body 31 in the second direction, and an actuator 43 to move the movable body 31 in the first direction against a biasing force of the at least one spring 40, and the at least one spring 40 includes a first spring 41 located radially outward of the cylindrical portion 31*a*.

With the working machine 1 according to item 12, since the first spring(s) 41 is/are located radially outward of the cylindrical portion 31*a*, there is less restriction on the installation space for the spring(s) than the case where the spring(s) is/are located radially inward of the cylindrical portion 31*a*. Therefore, the biasing force of the spring(s) can be increased by providing many first springs 41. Further, since many first springs 41 can be provided without increasing the outer diameter of the cylindrical portion 31*a*, an increase in the size of the movable body 31 can be prevented or reduced.

(Item 13) The working machine 1 according to item 12, wherein the at least one spring 40 includes the first spring 41 and a second spring 42 located radially inward of the cylindrical portion 31*a*.

With the working machine 1 according to item 13, the biasing force of the spring(s) can be increased using both the first spring(s) 41 and the second spring(s) 42. Further, since the first spring(s) 41 and the second spring(s) 42 are positioned radially outward and radially inward of the cylindrical portion 31*a*, respectively, many springs can be provided to increase the biasing force and the biasing force of the springs can be applied to the movable body 31 with good balance.

(Item 14) The working machine 1 according to item 12 or 13, wherein the movable body 31 includes a flange portion 31*b* integral with the cylindrical portion 31*a*, and the first spring 41 is attached to a hole 31*d* in the flange portion 31*b*.

With the working machine 1 according to item 14, there is no need to increase the size of the cylindrical portion 31*a* of the movable body 31 to achieve the installation space for the first spring(s) 41. Since the first spring(s) 41 is/are attached to the hole(s) 31*d*, it is possible to eliminate or reduce the likelihood that the first spring(s) 41 will be bent or come off the position.

(Item 15) The working machine 1 according to item 6, further including thrust bearings 36 each of which is attached to an outer peripheral surface of the corresponding shaft portion 33*a* and contacting an opposite surface of the corresponding head portion 33*b* from the corresponding protrusion 33*f*.

With the working machine 1 according to item 15, since each of the thrust bearings 36 rotatably supports the corresponding head portion 33*b*, the head portion 33*b* can smoothly turn relative to the rotator 18, and the inserts 33 can smoothly turn relative to the rotator 18. Furthermore, since the thrust bearing 36 can receive the force acting on the corresponding insert 33 in the axial direction of the insert 33, it is possible to eliminate or reduce the likelihood that the insert 33 will deform or be damaged.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A working machine comprising:

a fan to generate a first airflow to cool one or more apparatuses in a machine body, and a second airflow in a direction different from a direction of the first airflow;

wherein the fan includes:

a central shaft to rotate about an axis;

rotary blades each extending in a radial direction of the central shaft; and an angle change mechanism to change an angle of each of the rotary blades relative to the central shaft by turning the rotary blade about an axis extending in the radial direction;

the angle change mechanism includes:

a movable body that is movable in an axial direction of the central shaft; and a conversion mechanism to convert movement of the movable body into turning movement of the rotary blades;

the conversion mechanism includes:

inserts each inserted in the corresponding rotary blade in the corresponding radial direction;

fastenings to each fix the corresponding rotary blade and the corresponding insert to each other; and a turning mechanism to turn each of the inserts about the corresponding axis extending in the corresponding radial direction as the movable body moves;

the turning mechanism includes:

protrusions included in the respective inserts and protruding toward the central shaft; and engagement grooves provided in the movable body to engage with the protrusions;

each of the protrusions is offset from an axis of the corresponding insert and is rotatable in the corresponding engagement groove as the movable body moves;

each of the inserts is turnable together with the corresponding rotary blade about the corresponding axis extending in the corresponding radial direction as the corresponding protrusion rotates; and each of the protrusions has a shape of an elliptical column.

2. The working machine according to claim 1, wherein each of the rotary blades includes:

a blade body; and a holder to hold a portion of the blade body that is adjacent to the central shaft; and each of the fastenings is configured to fix the corresponding holder and the corresponding insert to each other.

3. The working machine according to claim 1, wherein each of the fastenings extends in a direction parallel to the central shaft.

4. The working machine according to claim 2, further comprising:

a rotator to rotate together with the central shaft and the rotary blades, the rotator including a tubular portion provided around the central shaft and insertion openings in the tubular portion to receive the respective holders; wherein the movable body is movable relative to the rotator.

5. The working machine according to claim 1, wherein each of the rotary blades includes:

a blade body; and a holder to hold a portion of the blade body that is adjacent to the central shaft;

each of the fastenings is configured to fix the corresponding holder and the corresponding insert to each other;

each of the inserts includes:

a shaft portion inserted in the corresponding holder; and a head portion provided at an end of the shaft portion that is adjacent to the central shaft and located outside the corresponding holder; and each of the protrusions is integral with the corresponding head portion.

6. The working machine according to claim 5, wherein each of the fastenings is configured to fix the corresponding shaft portion and the corresponding holder to each other.

7. The working machine according to claim 6, wherein each of the shaft portions includes a first through hole;

each of the holders includes a second through hole; and each of the fastenings is a bolt passing through the corresponding first through hole and the corresponding second through hole.

8. The working machine according to claim 1, wherein the movable body includes a cylindrical portion provided around the central shaft; and the engagement grooves are provided in the cylindrical portion.

9. The working machine according to claim 8, wherein each of the engagement grooves includes:

a first groove portion extending in a direction parallel to the central shaft; and a second groove portion continuous with the first groove portion and extending in a circumferential direction of the cylindrical portion;

the movable body is movable in a first direction along the axial direction, and in a second direction that is another direction along the axial direction; and each of the protrusions is rotatable in one direction in the second groove portion when the movable body moves in the first direction, and rotatable in another direction in the second groove portion when the movable body moves in the second direction.

10. The working machine according to claim 8, wherein the movable body is movable in a first direction along the axial direction, and in a second direction that is another direction along the axial direction;

the angle change mechanism includes:

at least one spring to bias the movable body in the second direction; and an actuator to move the movable body in the first direction against a biasing force of the at least one spring; and the at least one spring includes a first spring located radially outward of the cylindrical portion.

11. The working machine according to claim 10, wherein the at least one spring includes the first spring and a second spring located radially inward of the cylindrical portion.

12. The working machine according to claim 10, wherein the movable body includes a flange portion integral with the cylindrical portion; and the first spring is attached to a hole in the flange portion.

13. The working machine according to claim 5, further comprising thrust bearings each of which is attached to an outer peripheral surface of the corresponding shaft portion and contacting an opposite surface of the corresponding head portion from the corresponding protrusion.

14. A working machine comprising:

a fan to generate a first airflow to cool one or more apparatuses in a machine body, and a second airflow in a direction different from a direction of the first airflow; wherein the fan includes:

a central shaft to rotate about an axis;

rotary blades each extending in a radial direction of the central shaft; and an angle change mechanism to change an angle of each of the rotary blades relative to the central shaft by turning the rotary blade about an axis extending in the radial direction;

the angle change mechanism includes:

a movable body that is movable in an axial direction of the central shaft; and a conversion mechanism to convert movement of the movable body into turning movement of the rotary blades;

the conversion mechanism includes:

inserts each inserted in the corresponding rotary blade in the corresponding radial direction;

fastenings to each fix the corresponding rotary blade and the corresponding insert to each other; and a turning mechanism to turn each of the inserts about the corresponding axis extending in the corresponding radial direction as the movable body moves;

the turning mechanism includes:

protrusions included in the respective inserts and protruding toward the central shaft; and engagement grooves provided in the movable body to engage with the protrusions;

each of the protrusions is offset from an axis of the corresponding insert and is rotatable in the corresponding engagement groove as the movable body moves;

each of the inserts is turnable together with the corresponding rotary blade about the corresponding axis extending in the corresponding radial direction as the corresponding protrusion rotates;

the movable body includes a cylindrical portion provided around the central shaft;

the engagement grooves are provided in the cylindrical portion;

the movable body includes a flange portion integral with the cylindrical portion and is movable in a first direction along the axial direction, and in a second direction that is another direction along the axial direction;

the angle change mechanism includes:

at least one spring to bias the movable body in the second direction; and an actuator to move the movable body in the first direction against a biasing force of the at least one spring;

the at least one spring includes a first spring located radially outward of the cylindrical portion; and the first spring is attached to a hole in the flange portion.

* * * * *